US006739743B2

(12) United States Patent
Koshiro et al.

(10) Patent No.: US 6,739,743 B2
(45) Date of Patent: May 25, 2004

(54) LAMP DEVICE FOR VEHICLES, AND COMBINATION OF VEHICLE BODY AND LAMP DEVICE

(75) Inventors: Hiroshi Koshiro, Isehara (JP); Katsuhiko Inoue, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 32 days.

(21) Appl. No.: 10/183,042

(22) Filed: Jun. 27, 2002

(65) Prior Publication Data

US 2003/0012030 A1 Jan. 16, 2003

(30) Foreign Application Priority Data

Jun. 27, 2001 (JP) ..... 2001-194877
May 16, 2002 (JP) ..... 2002-142092

(51) Int. Cl.[7] ..... F21V 5/00

(52) U.S. Cl. ..... 362/520; 362/522; 362/496; 362/297

(58) Field of Search ..... 362/520, 507, 362/516, 540, 541, 542, 307, 310, 308, 328, 518, 306

(56) References Cited

U.S. PATENT DOCUMENTS

| | | | | |
|---|---|---|---|---|
| 4,704,661 A | | 11/1987 | Kosmatka | |
| 4,959,757 A | | 9/1990 | Nakata | |
| 5,067,053 A | | 11/1991 | Akizuki | |
| 5,603,561 A | * | 2/1997 | Ohishi | 362/522 |
| 5,688,043 A | * | 11/1997 | Watanabe et al. | 362/297 |
| 6,206,554 B1 | | 3/2001 | Schuster et al. | |
| 6,450,676 B2 | * | 9/2002 | Maeda et al. | 362/549 |

FOREIGN PATENT DOCUMENTS

| | | |
|---|---|---|
| JP | 10-074406 | 3/1998 |
| JP | 2001-35215 | 2/2001 |

* cited by examiner

*Primary Examiner*—Sandra O'Shea
*Assistant Examiner*—Ali Alavi
(74) *Attorney, Agent, or Firm*—Foley & Lardner

(57) ABSTRACT

A design structure is provided in the effective luminous region of a lamp device. Moreover, there is provided a unit which allows the optical path of a reflected light from a reflector to avoid the design structure is provided on the reflector. Therefore, the design structure can be positively provided in the effective luminous region of the lamp device, without affecting the light distribution, thereby increasing the degree of freedom in designing of the lamp device.

23 Claims, 25 Drawing Sheets http://www.OOO.com

LAMP DEVICE FOR VEHICLES, AND COMBINATION OF VEHICLE BODY AND LAMP DEVICE

FIELD OF THE INVENTION

This invention relates to a lamp device for vehicles ("lamp device"), in which a structure pertaining to design ("design structure") can be positively provided in the effective luminous region of the lamp device without affecting the light distribution, and the degree of freedom in designing of the lamp device can be improved. Moreover, this invention relates to a combination of vehicle body and a lamp device.

BACKGROUND OF THE INVENTION

A lamp device has been disclosed, for example, in U.S. Pat. No. 6,206,554 B1. This lamp device is used as an illuminating lamp which illuminates road surfaces or roads, and a signal lamp which informs vehicles and people in the vicinity thereof of the existence of the own vehicle by light. This lamp device is used such that the reflected light is irradiated to the outside at least without being affected substantially in a shield.

Recently, formed articles in view of the design are often provided on the lamp device from needs on the novel design of vehicles.

However, if a design structure is provided in the effective luminous region of the lamp device, there is the possibility that the reflected light from the reflector is affected by the design structure. Therefore, the conventional lamp device can only be provided outside the effective luminous region, and hence the degree of freedom in designing is limited.

In this specification, "vertical direction" and "horizontal direction" stand for the "vertical direction" and "horizontal direction" when the lamp device of this invention is equipped in the vehicle.

In this specification, "a surface of a lamp lens" stands for "a surface of a lamp lens facing outside", and "a reverse face of the lamp lens" stands for "a surface of the lamp lens facing a light chamber".

SUMMARY OF THE INVENTION

It is an object of this invention to provide a lamp device and a combination of a lamp device and vehicle body, in which a design structure can be provided within the effective luminous region thereof without affecting the light distribution and thus increase a degree of freedom in designing.

According to the present invention, a design structure is provided within the effective luminous region of the lamp device, and a unit which allows the optical path of the reflected light from the reflector to avoid the design structure is provided in the reflector.

According to the present invention, since the optical path of the reflected light from the reflector can avoid the design structure, the light distribution is not affected by the design structure. Therefore, according to this invention, the design structure can be positively provided in the effective luminous region of the lamp device, without affecting the light distribution, and hence the sense of unity of the vehicle body and the lamp device increases, thereby the degree of freedom in designing can be increased.

Other objects and features of this invention will become understood from the following description with reference to the accompanying drawings.

DETAIL DESCRIPTIONS

Figure 1:
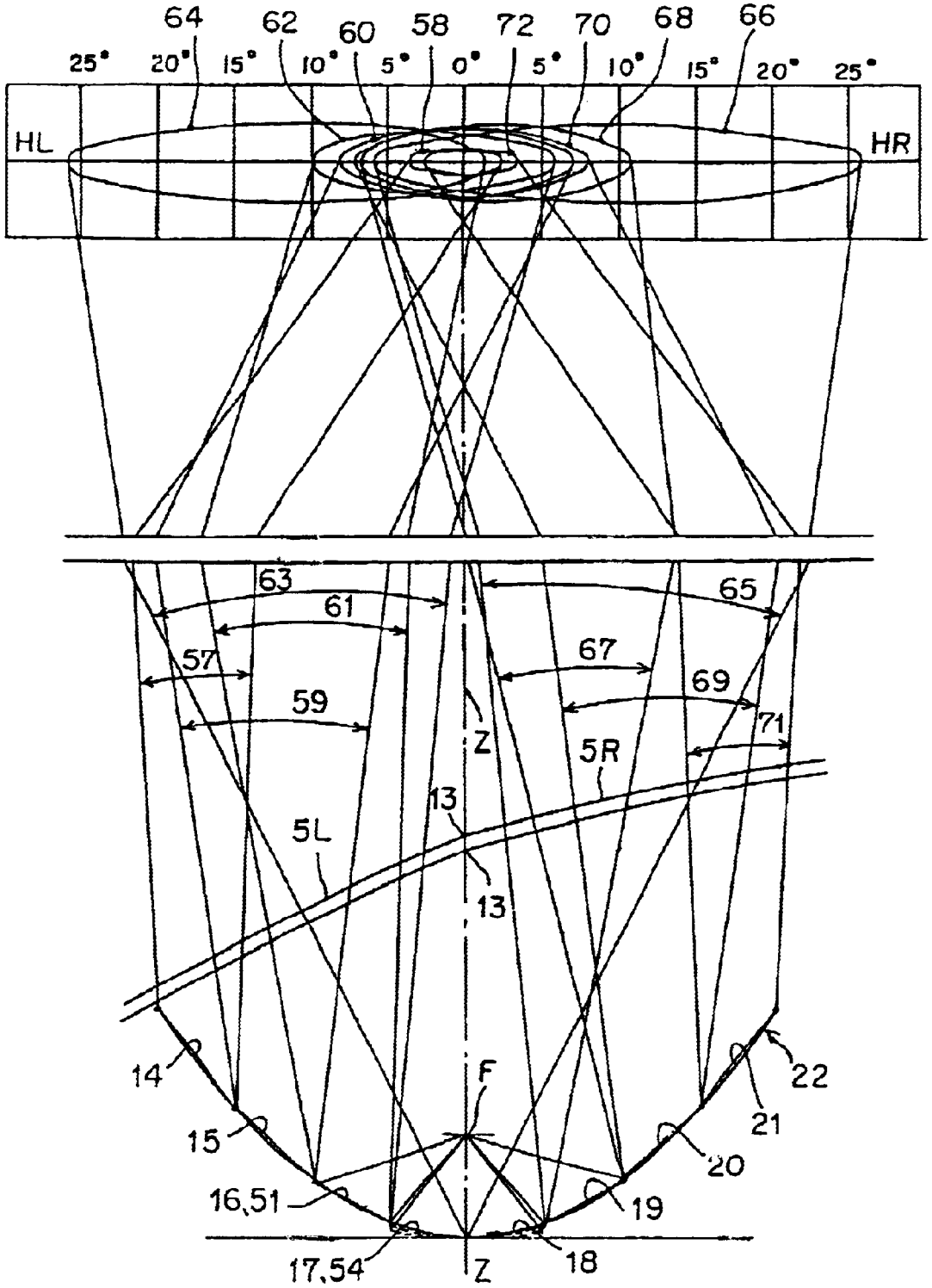
FIG. 1 is a diagram which explains each segment of a reflector, an optical path of a reflected light by each segment, and a light distribution pattern on a screen by each segment, which shows a first embodiment of the lamp device according to this invention.

Embodiments of the lamp device according to this invention will be explained below, with reference to the accompanying drawings. It is understood that this invention is not limited by those embodiments. In the drawings, hatching is omitted so that the explanation about the optical path can be easily understood.

The lamp device according to this invention is, as shown in FIG. 7 through FIG. 32, provided with a design structure in the effective luminous region, being the optical path of the reflected light from the lamp lens or from a reflector in the lamp chamber. Providing the design structure in the lamp device has recently been very popular. The design structure will be explained below, with reference to FIG. 7 through FIG. 32. An example in which the design structure is provided in the headlamp of a vehicle will be explained.

In FIG. 7 through FIG. 32, reference numeral 1 denotes a headlamp. This headlamp 1 is equipped on the right and left sides of the front part of a vehicle 2. This headlamp 1 is installed so as to be side by side with the outer plate of the vehicle body, such as fender, hood, grille or bumper.

The headlamp 1 comprises a lamp housing 4 which divides a lamp chamber 3 and a lamp lens 5, light source bulbs 6, 7 and 8 as a light source respectively arranged in the lamp chamber 3, and reflectors 9, 10 and 11. The light source 6 and the reflector 9 constitute a headlamp for driving. The light source 7 and the reflector 10 constitute a headlamp for passing by. The light source 8 and the reflector 11 constitute a side turn lamp. That is, the headlamp 1 is a so-called front combination lamp formed by combining the headlamp for driving, the headlamp for passing by and the side turn lamp.

The light source bulbs 6, 7 and 8 are lighted. Then, the light from the light source bulbs 6, 7 and 8 is respectively reflected on the reflecting surface of the reflectors 9, 10 and 11. This reflected light is passed through the lamp lens 5 and irradiated to the outside in a predetermined light distribution pattern. This headlamp 1 is for controlling the light distribution by the reflecting surface of the reflectors 9, 10 and 11. Therefore, the lamp lens 5 is a transparent cover of a plane lens. The lamp lens 5 may be a convex lens, a concave lens or a convexoconcave lens, other than the plane lens. The surface and the reverse face of the lamp lens 5 may be a torus curved surface or a free-form surface of NURBS (Non-Uniform Rational B-Spline Surface) (see Japanese Patent Application Laid-Open No. 2001-35215).

The reflectors 9, 10 and 11 are formed by combining the reflecting surface of the free-form surface of NURBS (Non-Uniform Rational B-Spline Surface) (see Japanese Patent Application Laid-Open No. 2001-35215). The reflecting surfaces of the reflectors 9, 10 and 11 are formed by aluminum evaporation or silver painting. The reflectors 9, 10 and 11 are formed of a plurality of segments (reflecting surface blocks).

In the effective luminous region, being the optical path of the reflected light from the reflectors 9, 10 and 11, of the lamp lens 5 and/or the lamp chamber 3 of the headlamp 1, there is provided a design structure.

Figure 7:
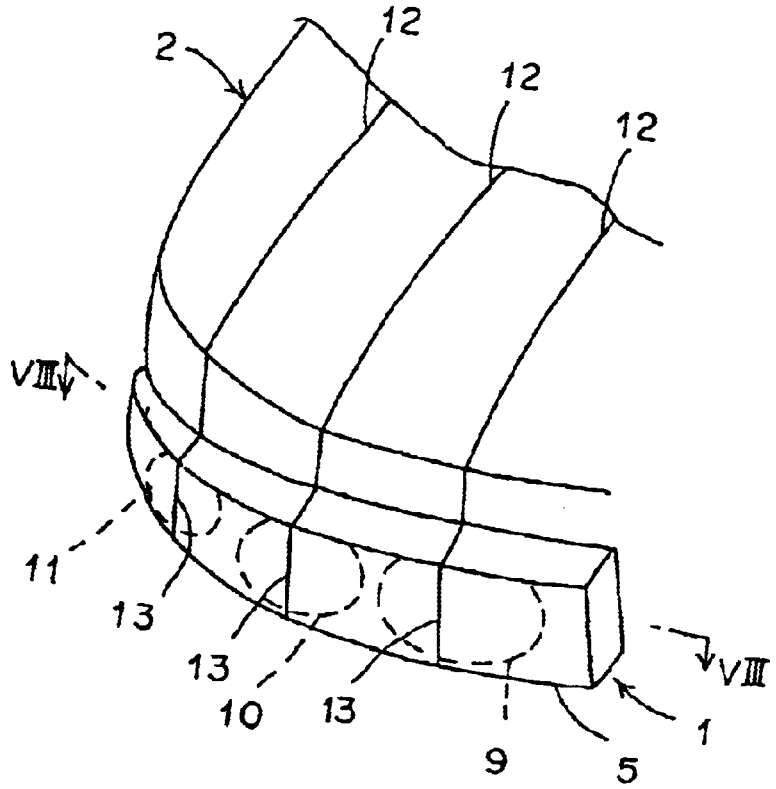
FIG. 7 is a partial perspective view which shows a headlamp and a vehicle body, having a vertical refractive section as a design structure.
Figure 8:
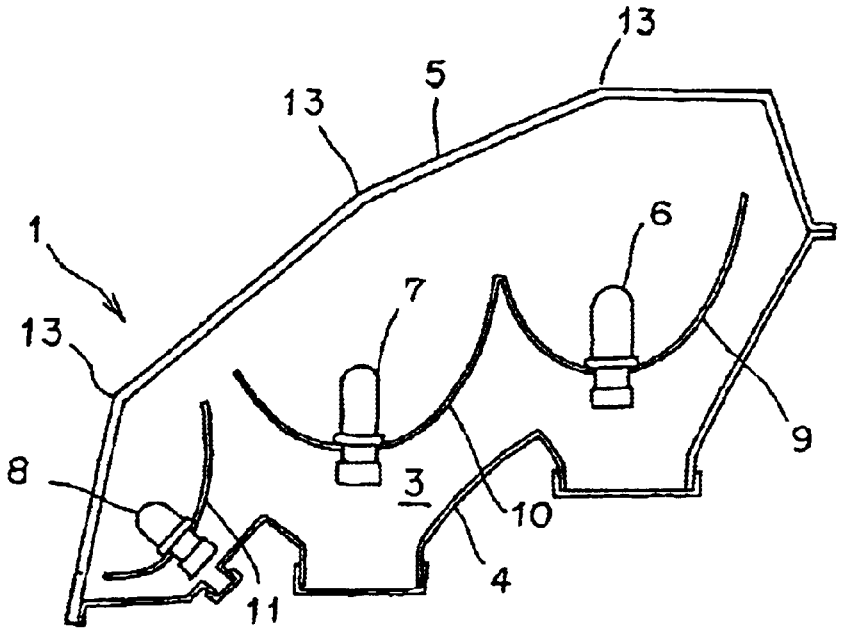
FIG. 8 is a sectional view along the line VIII—VIII in FIG. 7.

The design structure shown in FIG. 7 and FIG. 8 is a refractive section 13 in the form of line provided in the effective luminous region of the lamp lens 5 in the vertical direction. This vertical refractive section 13 is continuous to a press line 12 in view of the design provided on the vehicle body of the vehicle 2 (or a crevice line between the hood (bonnet) and the fender).

Figure 9:
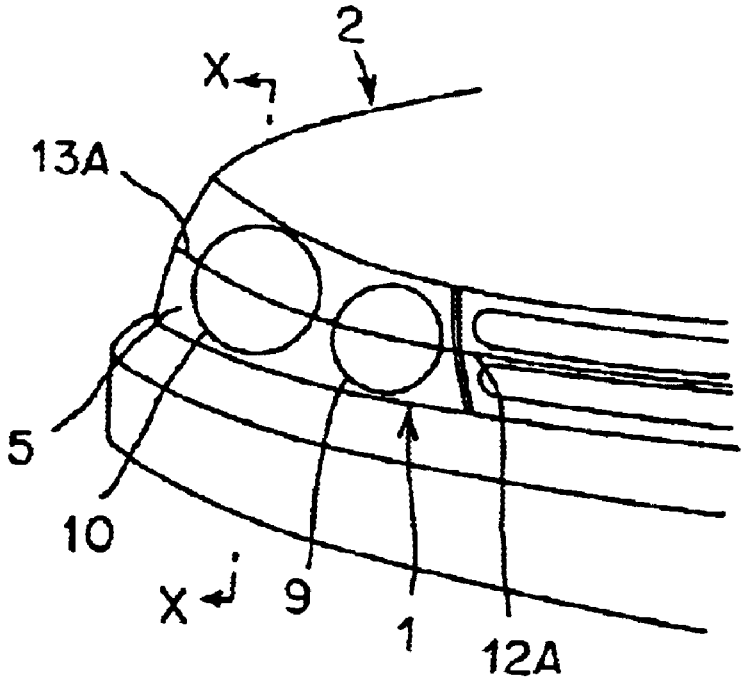
FIG. 9 is a partial perspective view which shows the headlamp and the vehicle body, having a horizontal refractive section as a design structure.
Figure 10:
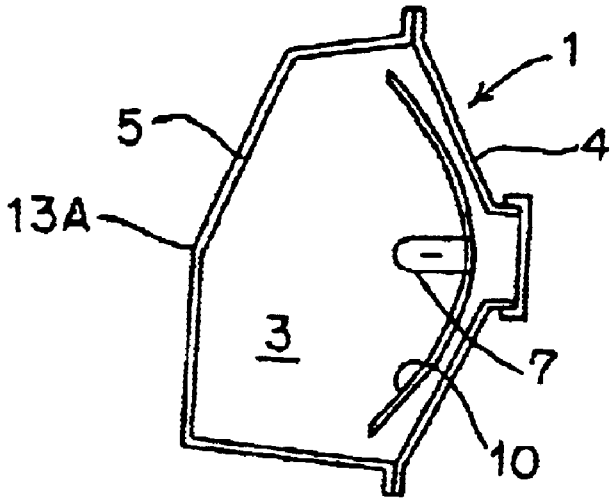
FIG. 10 is a sectional view along the line X—X in FIG. 9.

The design structure shown in FIG. 9 and FIG. 10 is a refractive section 13A in the form of line provided in the effective luminous region of the lamp lens 5 in the horizontal direction. This horizontal refractive section 13A is continuous to a press line 12A in view of the design provided on the vehicle body of the vehicle 2 (or a refractive section in the form of line).

Figure 11:
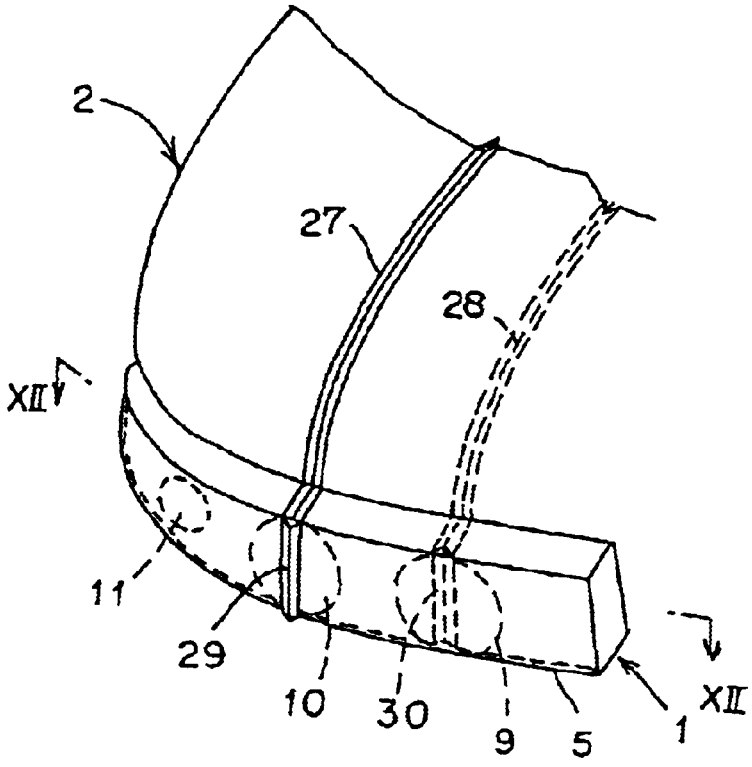
FIG. 11 is a partial perspective view which shows the headlamp and the vehicle body, having a surface convex prism pattern and a reverse face convex prism pattern in the vertical direction, as the design structure.
Figure 12:
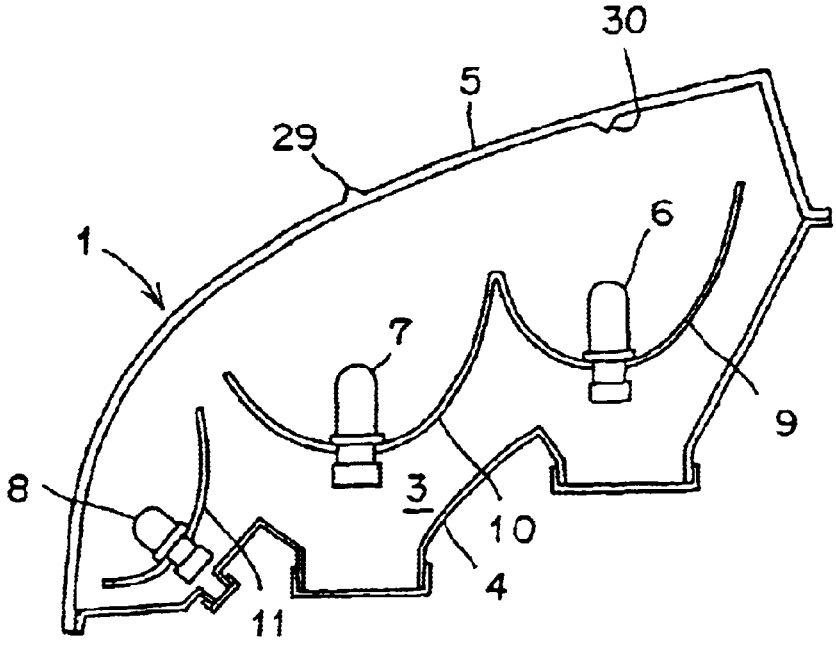
FIG. 12 is a sectional view along the line XII—XII in FIG. 11.

The design structure shown in FIG. 11 and FIG. 12 is a prism section in the form of line provided on the surface and/or the reverse face in the effective luminous region of the lamp lens 5 in the vertical direction. The prism section in the form of line comprises a surface convex prism pattern 29 and a reverse face convex prism pattern 30, which are respectively continuous to a triangular convex line 27 and a triangular concave line 28 in view of the design provided on the vehicle body of the vehicle 2.

Figure 13:
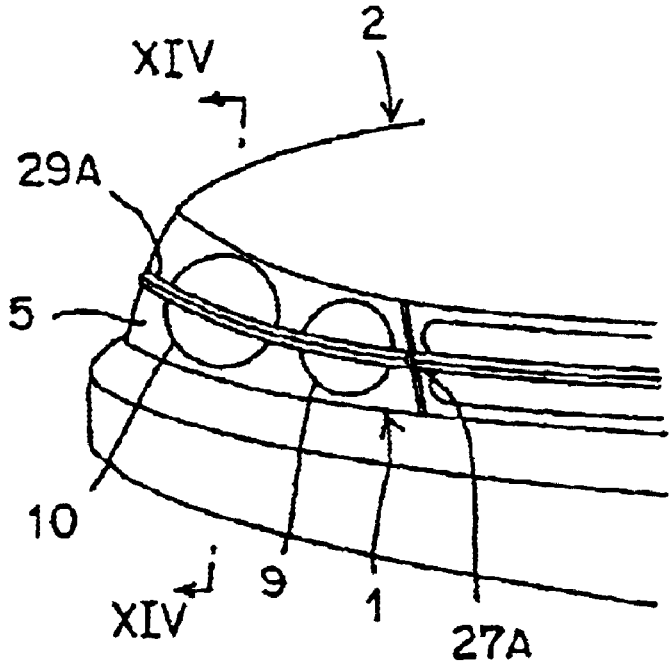
FIG. 13 is a partial perspective view which shows the headlamp and the vehicle body, having a surface convex prism pattern in the horizontal direction, as the design structure.
Figure 14:
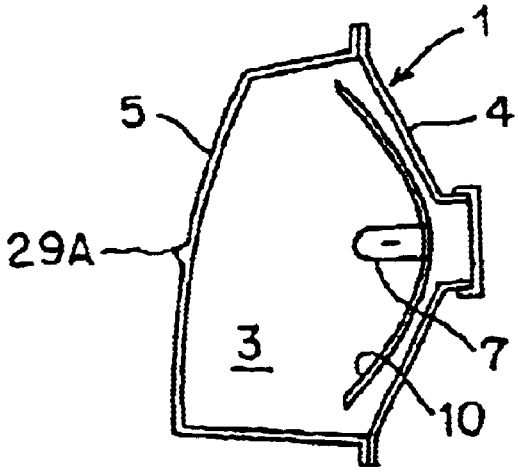
FIG. 14 is a sectional view along the line XIV—XIV in FIG. 13.

The design structure shown in FIG. 13 and FIG. 14 is a prism section in the form of line provided on the surface and/or the reverse face in the effective luminous region of the lamp lens 5 in the vertical direction. The prism section in the form of line comprises a surface convex prism pattern 29A, which is continuous to a triangular convex line 27A in view of the design provided on the vehicle body of the vehicle 2.

Figure 15:
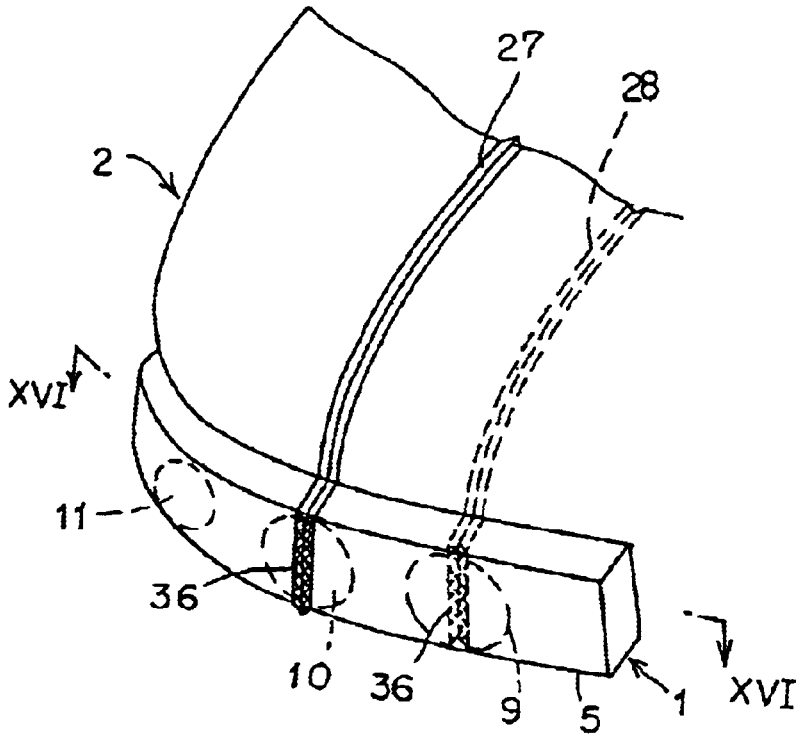
FIG. 15 is a partial perspective view which shows the headlamp and the vehicle body having a non-light passing pattern in the vertical direction, as the design structure.
Figure 16:
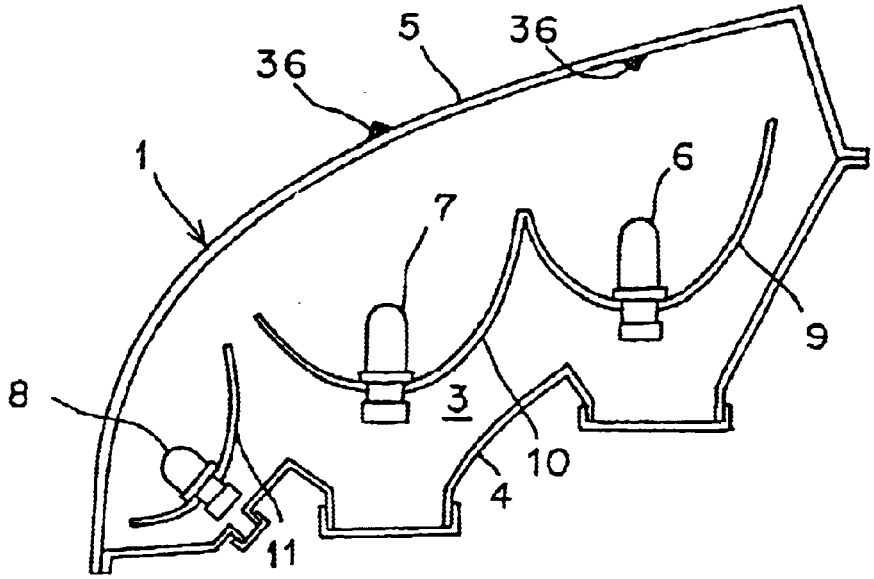
FIG. 16 is a sectional view along the line XVI—XVI in FIG. 15.

The design structure shown in FIG. 15 and FIG. 16 is a non-light passing section in the form of line provided on the surface and/or the reverse face in the effective luminous region of the lamp lens 5 in the vertical direction. The non-light passing section in the form of line is a non-light passing pattern 36 in the form of two lines, which are respectively continuous to the triangular convex line 27 (convex line) and the triangular concave line 28 (concave line) in view of the design provided on the vehicle body of the vehicle 2.

Figure 17:
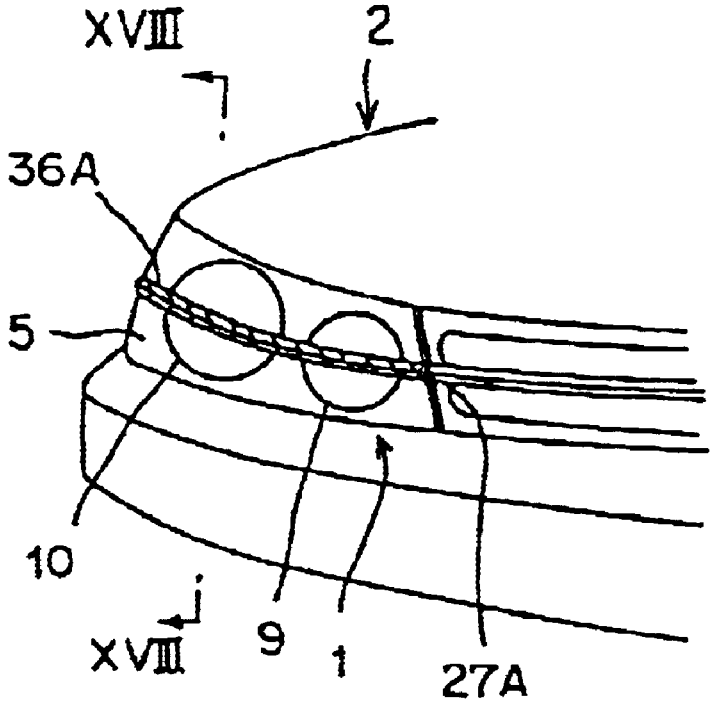
FIG. 17 is a partial perspective view which shows the headlamp and the vehicle body having a non-light passing pattern in the horizontal direction, as the design structure.
Figure 18:
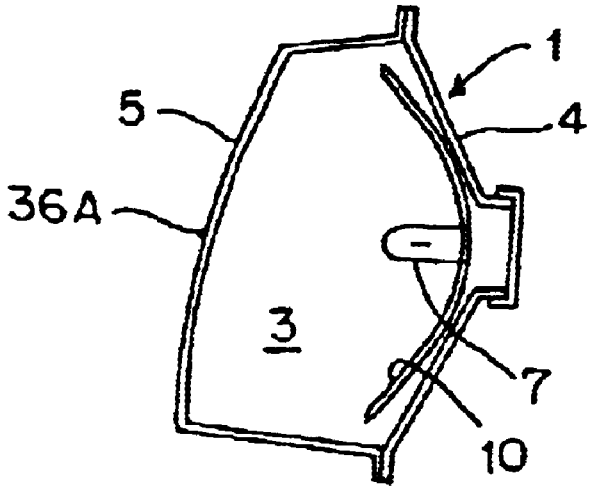
FIG. 18 is a sectional view along the line XVIII—XVIII in FIG. 17.

The design structure shown in FIG. 17 and FIG. 18 is a non-light passing section in the form of line provided on the surface and/or the reverse face in the effective luminous region of the lamp lens 5 in the horizontal direction. The non-light passing section in the form of line is a non-light passing pattern 36 in the form of one line, which is continuous to the triangular convex line 27 (convex line) in view of the design provided on the vehicle body of the vehicle 2.

The non-light passing pattern 36 is formed such that a pole-like non-light passing member of a triangular shape in cross section, being a separate body from the lamp lens 5, is provided in the vertical or horizontal direction on the surface and/or the reverse face of the lamp lens 5 in the effective luminous region. The non-light passing pattern 36 may be one obtained by applying a non-light passing paint on the surface of the surface convex prism pattern 29 or 29A, or the reverse face convex prism pattern 30, shown in FIG. 11 through FIG. 14. Alternatively, it may have a shape other than the triangular shape in cross section.

Figure 19:
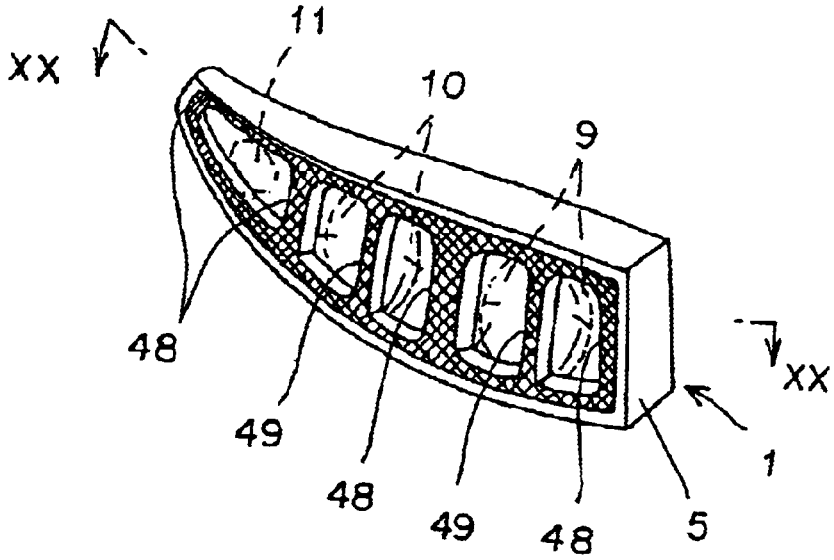
FIG. 19 is a partial perspective view which shows the headlamp and the vehicle body having a partition section of an inner panel in the vertical direction, as the design structure.
Figure 20:
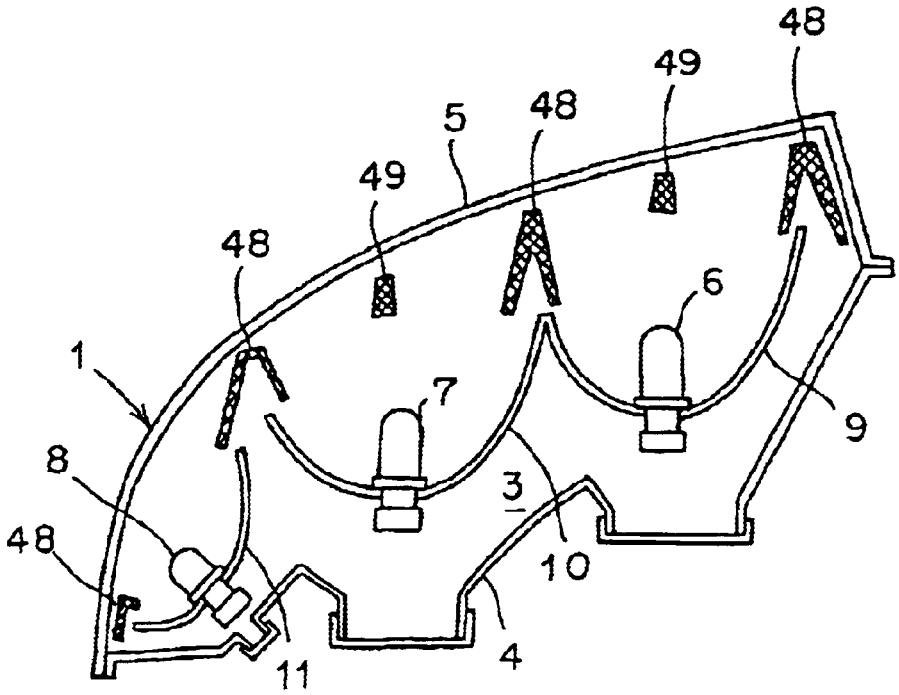
FIG. 20 is a sectional view along the line XX—XX in FIG. 19.

The design structure shown in FIG. 19 and FIG. 20 is a partition section 49 provided in the effective luminous region in the lamp chamber 3 in the vertical direction, facing the lamp lens 5. This partition section 49 is provided in a non-light passing inner panel 48 arranged in the lamp chamber 3. The partition section 49 is non-light passing like the inner panel 48, and when the lamp chamber 3 is seen through the lamp lens 5, it makes the lamp chamber 3 look like a simulated multiple light lamp in which the lamp chamber is divided into a plurality of numbers (in this example, two) horizontally.

That is, the inner panel 48 apparently separates the headlamp for driving, the headlamp for passing by and the side turn lamp of the headlamp 1. By providing two partition sections 49 in this inner panel 48 in the horizontal direction, the lamp chamber 3 of one headlamp for driving and one headlamp for passing by appears to be two, right and left, respectively.

Figure 21:
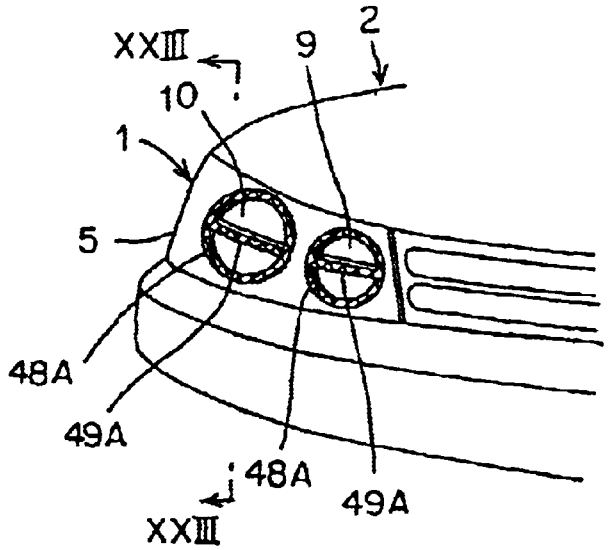
FIG. 21 is a partial perspective view which shows the headlamp and the vehicle body having a partition section of the inner panel in the horizontal direction, as the design structure.
Figure 22:
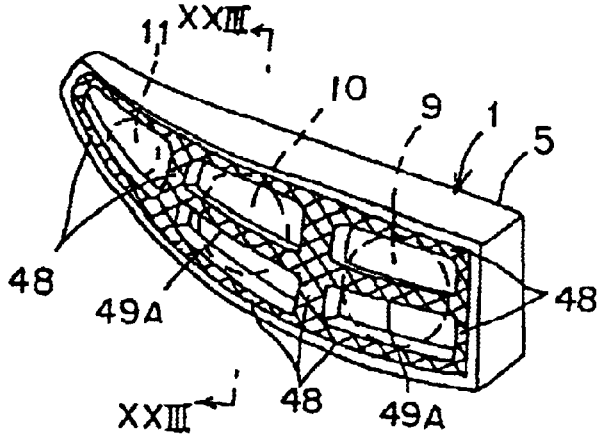
FIG. 22 is a sectional view along the line XXII—XXII in FIG. 21.
Figure 23:
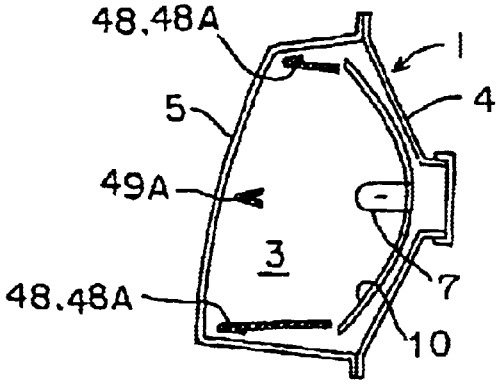
FIG. 23 is a sectional view along the line XXIII—XXIII in FIG. 21.

The design structure shown in FIG. 21 through FIG. 23 is a partition section 49A provided in the effective luminous region in the lamp chamber 3 in the horizontal direction, facing the lamp lens 5. This partition section 49A is provided in non-light passing inner panels 48 and 48A arranged in the lamp chamber 3. The partition section 49A is non-light passing like the inner panels 48 and 48A, and when the lamp chamber 3 is seen through the lamp lens 5, it makes the lamp chamber 3 look like a simulated multiple light lamp in which the lamp chamber is divided into a plurality of numbers (in this example, two) vertically.

That is, the inner panel 48 separates the headlamp for driving and the headlamp for passing by, of the headlamp 1, apparently into rectangles. Further, the inner panel 48A separates the headlamp for driving and the headlamp for passing by, of the headlamp 1, apparently into a circular shape. By providing the partition section 49A in this inner panel 48 or 48A in the vertical direction, the lamp chamber 3 of one headlamp for driving and one headlamp for passing by appears to be two, up and down, respectively.

Basically, the partition sections 49 and 49A are integrally formed with the inner panels 48 and 48A. However, according to circumstances, the partition sections 49, 49A may be formed by resin molding or metal die-cast molding, separately from the inner panels 48 and 48A, and the partition sections 49, 49A of the separate piece may be fixed by a screw or the like to the inner panels 48 and 48A. Further, the inner panels (or inner housings or extensions) 48 and 48A cover the space of ineffective portion and prevent the inner structure from being seen, and prevent the light from the light source bulbs 6, 7 and 8 from leaking in the direction other than the predetermined direction.

Figure 24:
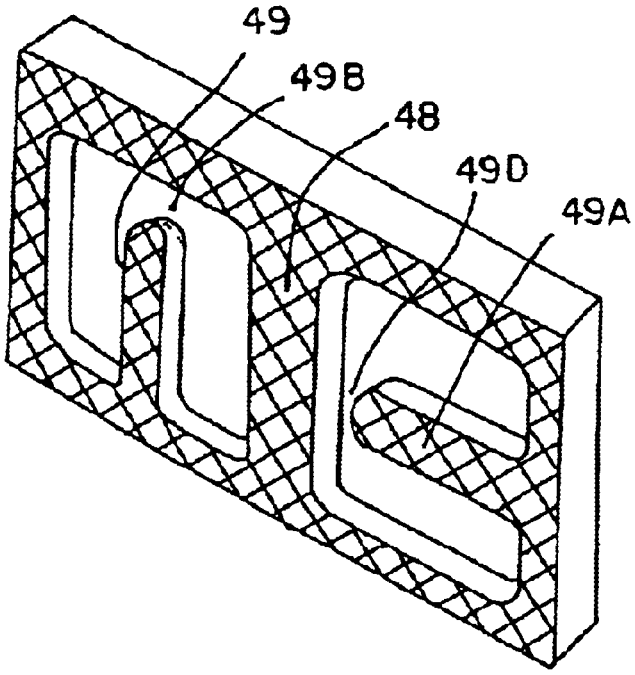
FIG. 24 is a partial perspective view which shows a modification example of the partition section of the inner panel in the horizontal direction, as the design structure.
Figure 25:
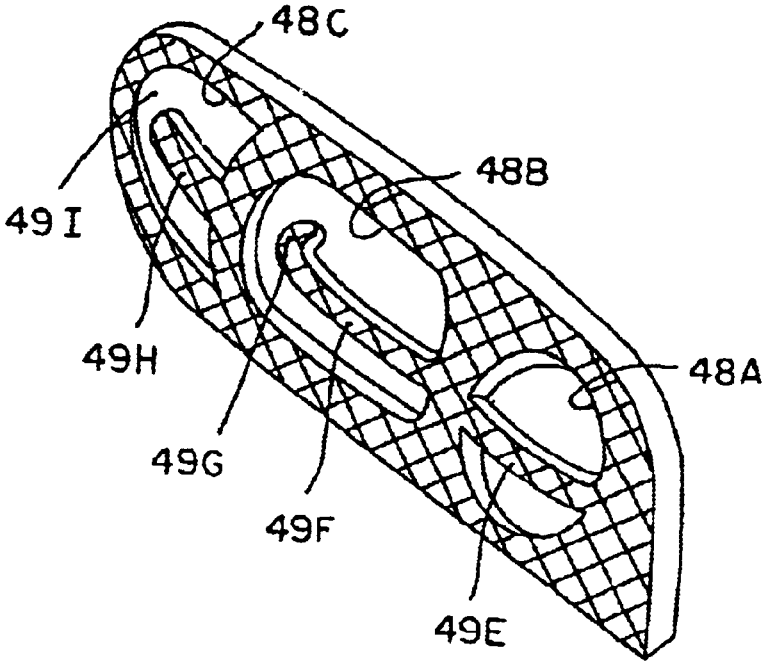
FIG. 25 is a partial perspective view which shows a modification example of the partition section of the inner panel in the horizontal direction, as the design structure.

FIG. 24 and FIG. 25 are perspective views which show modification examples of the inner panel and the partition section. That is, as shown in FIG. 24, there may be provided openings 49B and 49D, respectively, between the ends of the vertical partition section 49 and the horizontal partition section 49A and the opening of the inner panel 48 which divides into rectangular shapes. Also as shown in FIG. 25, the opening of the inner panel may be an elliptical shape 48B or a triangular shape 48C, other than the square inner panel 48 or the circular inner panel 48A. Further, as shown in FIG. 25, the partition section may be a horizontal partition section 49E curved outwards, one having a horizontal partition section 49F with the edge 49G bent upwards, or one having an opening 49I between the end of a horizontal partition section 49H curved outwards and the triangular opening 48C of the inner panel.

Figure 26:
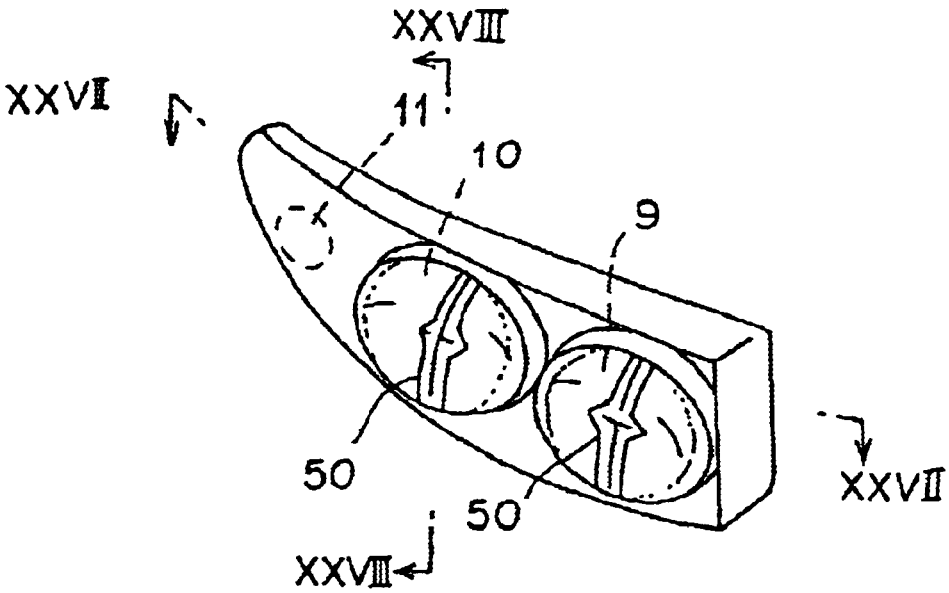
FIG. 26 is a partial perspective view which shows the headlamp and the vehicle body having a shade in the vertical direction, as the design structure.
Figure 27:
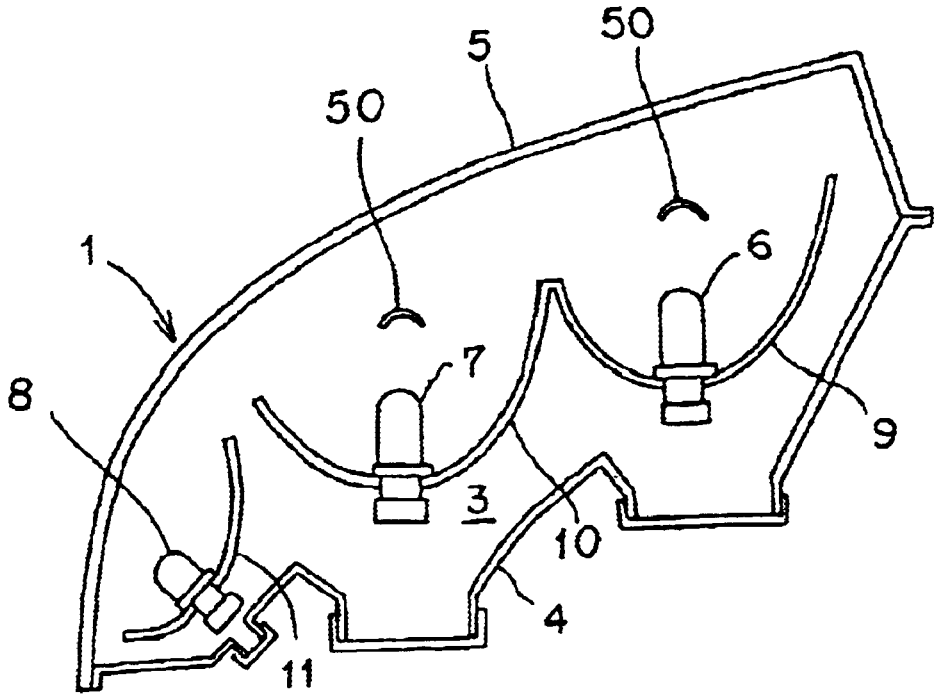
FIG. 27 is a sectional view along the line XXVII—XXVII in FIG. 26.
Figure 28:
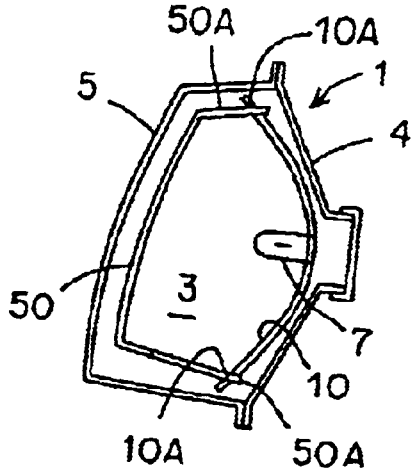
FIG. 28 is a sectional view along the line XXVIII—XXVIII in FIG. 26.

The design structure shown in FIG. 26 through FIG. 28 is a shade 50 in the form of partition provided vertically, facing the lamp lens 5 in the effective luminous region of the lamp chamber 3. This shade 50 is provided in the reflectors 9, 10 arranged in the lamp chamber 3. That is, upper and lower mounting legs 50A of the shade 50 are fitted to upper and lower mounting holes 104 of the reflectors 9, 10.

In front of this shade 50, there is provided a reflecting surface by aluminum evaporation or silver painting. When the lamp chamber 3 is seen through the lamp lens 5, this shade 50 makes the lamp chamber 3 look like a simulated multiple light lamp in which the lamp chamber 3 is divided into a plurality of numbers (in this example, two) horizontally. That is, the lamp chamber 3,in one headlamp for driving and one headlamp for passing by respectively appears to be two separated horizontally.

Figure 29:
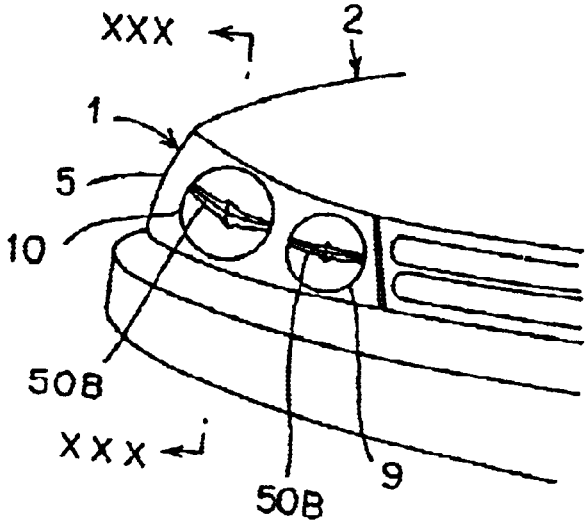
FIG. 29 is a partial perspective view which shows the headlamp and the vehicle body having a shade in the horizontal direction, as the design structure.
Figure 30:
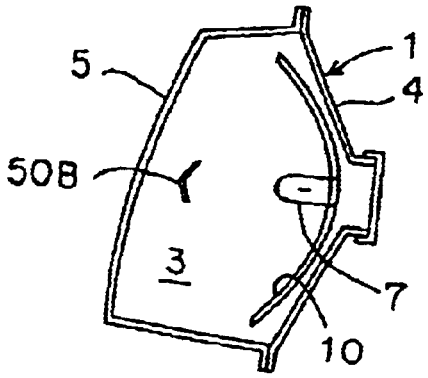
FIG. 30 is a sectional view along the line XXX—XXX in FIG. 29.

The design structure shown in FIG. 29 and FIG. 30 is a shade 50B in the form of partition provided horizontally, facing the lamp lens 5 in the effective luminous region of the lamp chamber 3. This shade 50B is provided in the reflectors 9, 10 arranged in the lamp chamber 3, in the same manner as the shade 50. In front of this shade 50B, there is provided a reflecting surface. When the lamp chamber 3 is seen through the lamp lens 5, this shade 50B makes the lamp chamber 3 look like a simulated multiple light lamp in which the lamp chamber 3 is divided into a plurality of numbers (in this example, two) vertically. That is, the lamp chamber 3 in one headlamp for driving and one headlamp for passing by respectively appears to be two separated vertically.

Figure 31:
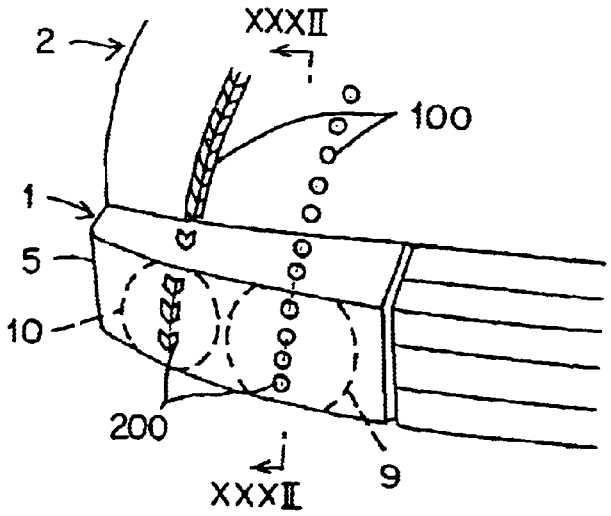
FIG. 31 is a partial perspective view which shows a modification example of a line pertaining to design of the vehicle body and a line pertaining to design on a lamp lens.

FIG. 31 is a partial perspective view which shows a modification example of a line pertaining to design on the vehicle body and a line pertaining to design on the lamp lens. In this FIG. 31, a continuous line 100 in view of the design and an intermittent line 100 in view of the design are respectively provided on the frame of the vehicle 2. On the other hand, in the effective luminous region of the lamp lens 5 (reflectors 9, 10), there are provided lines 200 respectively continuous to the two lines in view of the design on the vehicle body.

Figures 32A, 32B, 32C, 32D:
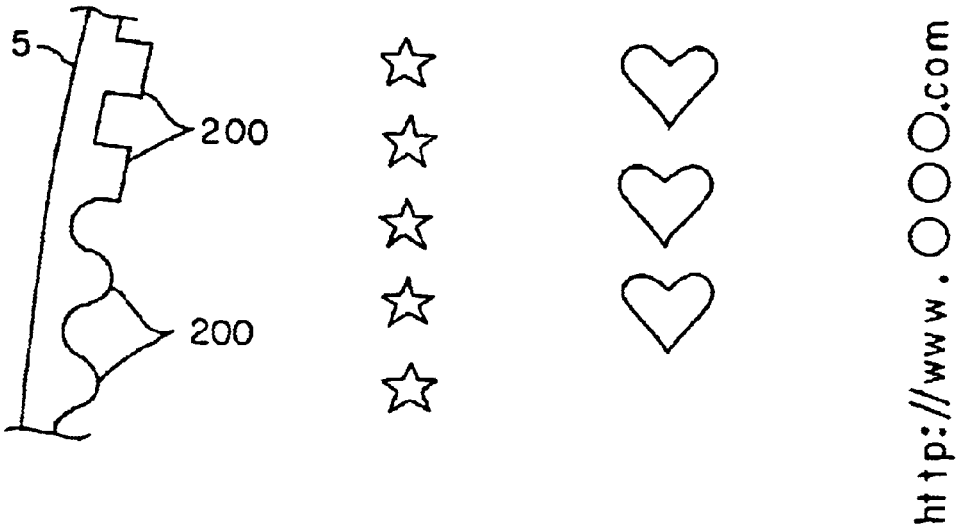
FIG. 32A is a sectional view along the line XXXII—XXXII shown in FIG. 31.
FIG. 32B is an explanatory diagram which shows that the line pertaining to design is star marks lined up in a row intermittently.
FIG. 32C is an explanatory diagram which shows that the line pertaining to design is heart marks lined up in a row intermittently.
FIG. 32D is an explanatory diagram which shows that the line pertaining to design is an address of the Internet HP lined up in a row intermittently.

The lines 200 in view of the design on the lamp lens are formed, as shown in FIG. 32A, by providing intermittently continuous convex and concave portions in the form of line on the reverse face of the lamp lens 5. As the line pertaining to design, for example, there can be mentioned star marks intermittently lined up in a row as shown in FIG. 32B, heart marks intermittently lined up in a row as shown in FIG. 32C, an address of the Internet HP intermittently lined up in a row as shown in FIG. 32D, and circles, ovals, polygons, arrows, signs, characters, house marks, etc.

The line pertaining to design on the vehicle body includes one or a plurality of press line 12, crevice line between the hood and the fender, triangular convex line 27, triangular concave line 28, convex line, concave line, joint line of the vehicle body, paint line, printing line, line of a separate piece attached afterwards, etc. On the other hand, the line pertaining to design on the lamp lens 5 includes one or a plurality of refractive section in the form of line, prism section in the form of line, non-light passing section in the form of line, convex and concave portion in the form of line, painting section in the form of line, printer in the form of line, and stamper in the form of line. The line pertaining to design on the vehicle body and the line pertaining to design on the lamp lens include a line continuously lined up in a row and a line intermittently lined up in a row. As described above, the lamp lens and the vehicle body can be provided with various lines in view of the design.

When the design structure 13, 13A, 29, 29A, 30, 36, 36A, 49, 49A, 49E, 49F, 49H, 50, 50B or 200 is provided in the effective luminous region of the lamp lens 5 and/or the lamp chamber 3, the light distribution controlled by the reflectors 9, 10 and 11 may be affected by the design structure. The influence of the design structure upon the light distribution will now be explained with reference FIG. 33 through FIG. 40. In FIG. 33 through FIG. 40, the same reference numerals are given to the parts same as those in FIG. 7 through FIG. 32.

Figure 33:
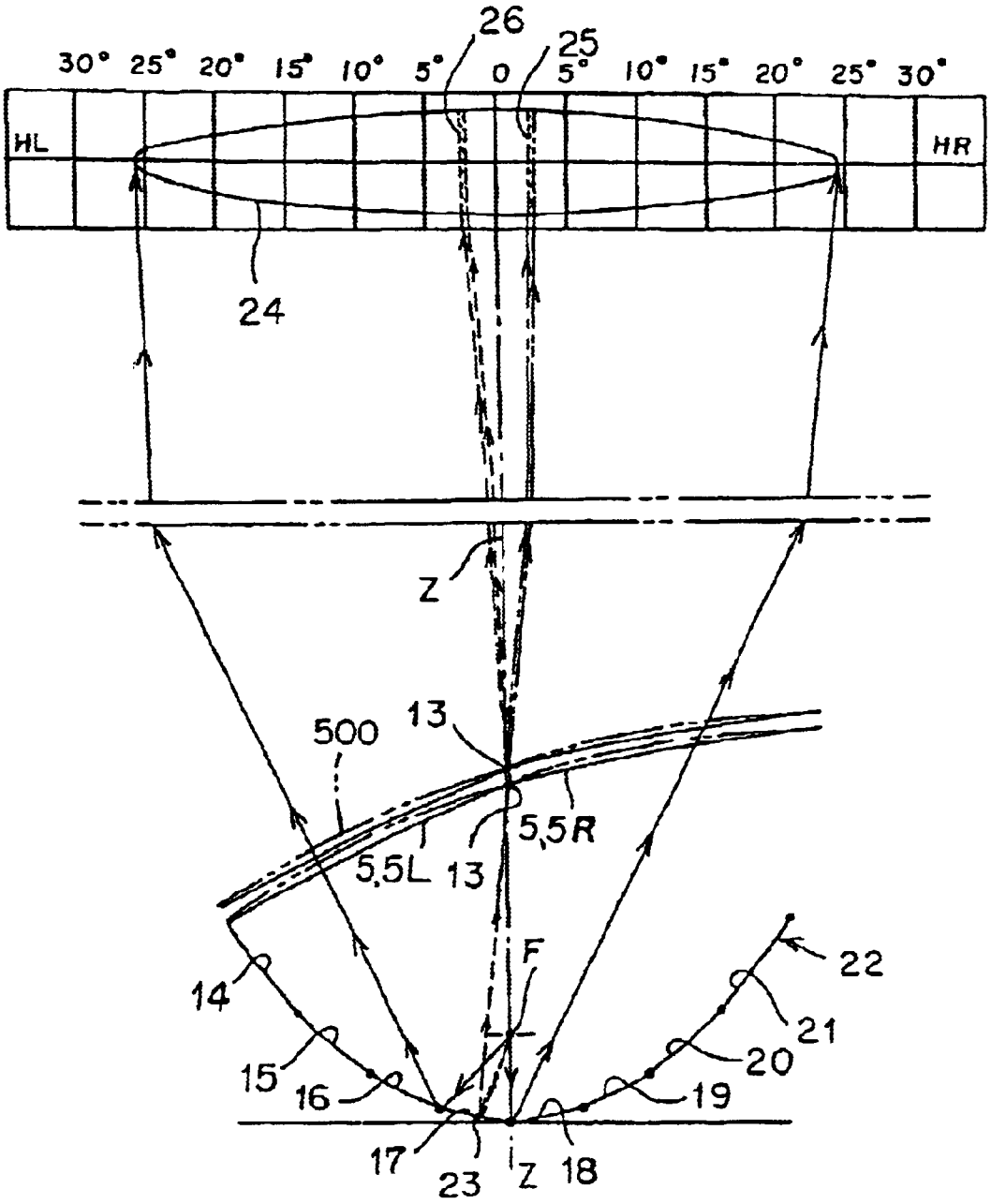
FIG. 33 is a diagram which explains each segment of a reflector which shows the lamp device, in which the design structure is a refractive section in the vertical direction, an optical path of a reflected light by each segment, and a light distribution pattern on a screen by each segment.
Figure 34:
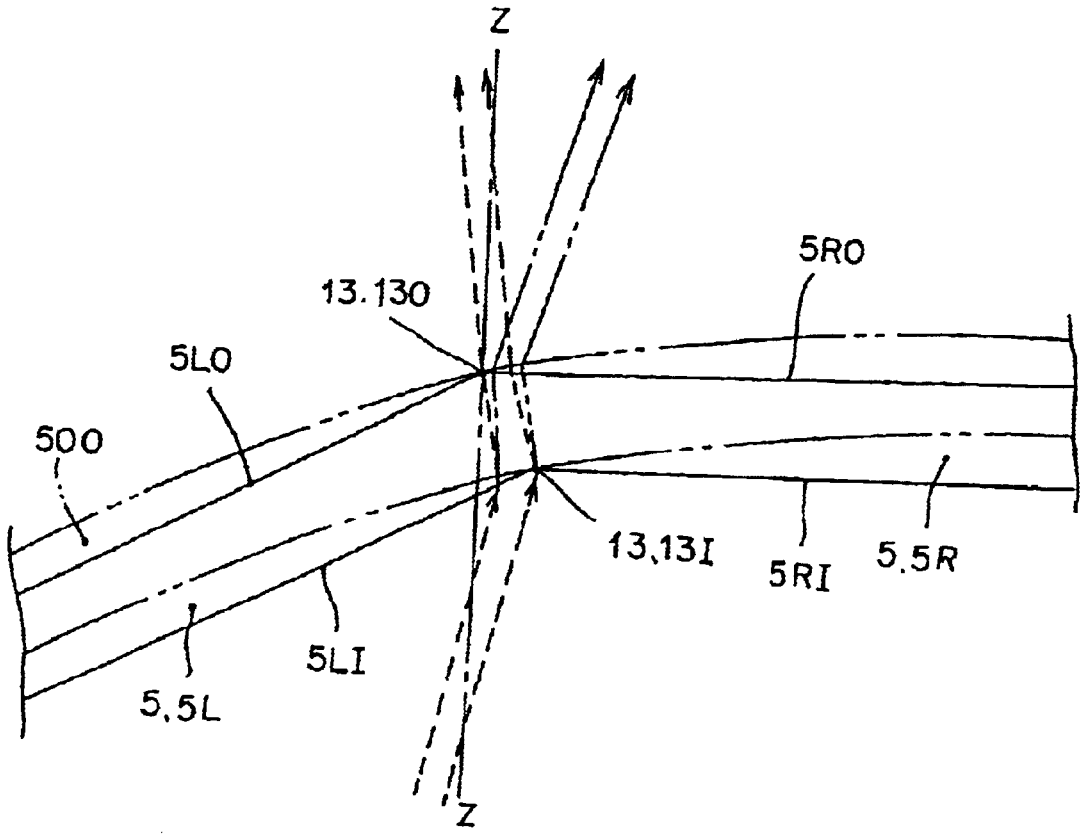
FIG. 34 is an explanatory diagram which shows the refractive section in an enlarged scale.

FIG. 33 and FIG. 34 are explanatory diagrams which respectively show the influence of the vertical refractive section 13 upon the light distribution. In this case, the reflected light from the reflector 22 is refracted when passing the refractive section 13 and the vicinity thereof. Therefore, a streak 25 of a dark portion where the refracted reflected light comes off and a streak 26 of a bright portion where the refracted reflected light is overlapped respectively appear in the light distribution pattern 24. The theory of appearance of the streak 25 of the dark portion and the streak 26 of the bright portion will be explained in detail, with reference to FIG. 33 and FIG. 34.

The reflector 22 is for controlling the light distribution, and is formed by combining the reflecting surface of the free-form surface of NURBS (Non-Uniform Rational B-Spline Surface) (see Japanese Patent Application Laid-Open No. 2001-35215). The reflecting surface of the reflector 22 is formed by aluminum evaporation or silver painting. As described above, by making the reflecting surface of the reflector 22 the free-form surface of the NURBS, the reflecting surface of the reflector 22 can be formed by controlling so as to have high accuracy, high speed and high degree of freedom.

The reflector 22 is formed of a plurality of segments, in this example, eight segments, that is, a first segment 14 to an eighth segment 21 from the left, in the horizontal cross section. In this reflector 22, the boundaries between the segments 14 to 21 can be seen as in this example. However, in the continuous segment (when the segments are continuously formed), the boundaries between segments may be not seen. In this reflector 22, the paraboloid is set to be a reference reflecting surface (basic reflecting surface) in the horizontal cross section.

At the focal point F of the reflector 22, though the reflector 22 does not have a single focal point in a strict meaning, the difference in the focal length between the pluralities of reflecting surfaces is small, and hence substantially the same focal point is shared by the reflecting surfaces. Therefore, substantially the same focal point is referred to as a pseudo-focal point F (or simply as a focal point) in this specification and the drawings. Similarly, in the optical axis Z—Z of the reflector 22, though the reflector 22 does not have a single optical axis in a strict meaning, the difference in the optical axis between the pluralities of reflecting surfaces is small, and hence substantially the same optical axis is shared. Therefore, substantially the same optical axis is referred to as a pseudo-optical axis (or simply as an optical axis) Z—Z in this specification and the drawings. The center of the filament (or emission section) of the light source bulb 7 is arranged in the vicinity of the focal point F of the reflector 22.

On the other hand, the refractive section 13 in the form of line is vertically provided in the effective luminous region of the lamp lens 5. This lamp lens 5 comprises a left portion 5L and a right portion 5R having a different inclination, centering on the refractive section 13. That is, in the lamp lens 5, the inclination of the surface 5LO of the left portion 5L and the inclination of the surface 5RO of the right portion are different at the refractive section 13O on the surface, and the inclination of the reverse face 5LI of the left portion 5L and the inclination of the reverse face 5RI of the right portion 5R are different at the refractive section 13I on the reverse face. In FIG. 33 and FIG. 34, reference numeral 500 denotes a lamp lens having no refractive section (shown by a two-dot chain line).

Of the eighth segments 14 to 21, the reflected light from a point 23 in the fourth segment 17 will be explained. At first, the light distribution pattern 24 by the reflected light from the fourth segment 17 becomes, as shown by a solid line in FIG. 33, a spread light distribution pattern from about 26° on the left to about 24° on the right, both for the lamp lens 5 having the refractive section 13 and for the lamp lens 500 having no refractive section 13.

At this time, the reflected light from the point 23 in the fourth segment 17 (the reflected light before passing the lamp lens 5 is shown by a dotted line in the figure) passes the lamp lens 500, in the lamp lens 500 having no refractive section 13, and advances rightwards with respect to the optical axis (or an axis parallel with the optical axis) Z—Z. However, in the lamp lens 500 having the refractive section 13, as shown by a dotted line in the figure, the reflected light is refracted when passing the refractive section 13 and the vicinity thereof, and advances leftwards with respect to the optical axis Z—Z. This is because when the reflected light entered into the reverse face 5LI of the left portion 5L of the lamp lens 5 is emitted from the surface 5RO of the right portion 5R of the lamp lens 5,the reflected light is refracted by the prism effect due to a difference in angle between the plane of incidence of the reflected light (the reverse face 5LI of the left portion 5L of the lamp lens 5) and the output plane of the reflected light (the surface 5RO of the right portion 5R of the lamp lens 5)

Therefore, as shown in FIG. 33, in the lamp lens 500 without having the refractive section 13, the reflected light is irradiated. However, in the lamp lens 5 having the refractive section 13, the reflected light is not irradiated but comes off, and the vertical streak 25 of the dark portion is formed in the light distribution pattern 24 of from about 2° to 3° on the right. On the other hand, in the lamp lens 500 having no refractive section 13, the reflected light is not be irradiated. However, in the lamp lens 5 having the refractive section 13, the reflected light is irradiated and overlapped, to thereby form a vertical streak 26 of the bright portion in the light distribution pattern 24 of from about 2° to 3° on the left. As a result, the visibility is deteriorated, and it is not desirable in the appearance.

The streak 25 of the dark portion and the streak 26 of the bright portion shown in FIG. 33 are formed by the reflected light from the fourth segment 17. Here, for example, it is assumed that the reflected light from the third segment 16 to the sixth segment 19 pass through the refractive section 13 and the vicinity thereof. Then, in the light distribution pattern 24, four streaks of the dark portion and four streaks of the bright portion are respectively formed.

Figure 35:
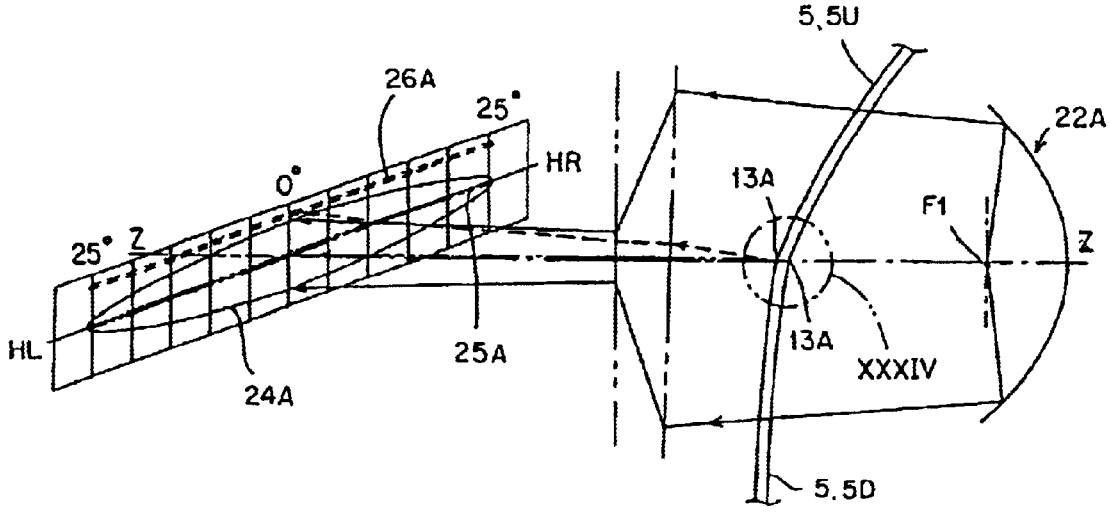
FIG. 35 is a diagram which explains each segment of a reflector which shows the lamp device, in which the design structure is a refractive section in the horizontal direction, an optical path of a reflected light by each segment, and a light distribution pattern on a screen by each segment.
Figure 36:
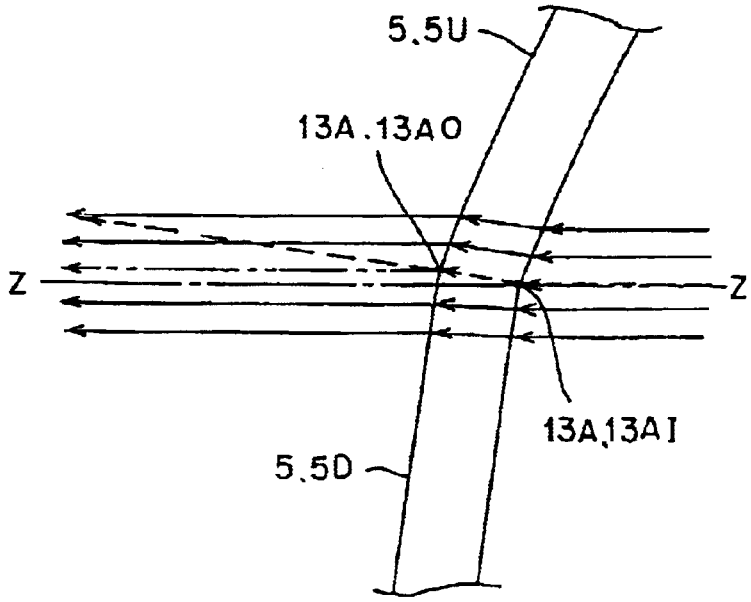
FIG. 36 is an explanatory diagram which shows the refractive section in an enlarged scale.

FIG. 35 and FIG. 36 are explanatory diagrams which show the influence of the horizontal refractive section 13A upon the light distribution. In this case, the reflected light from the reflector 22A is refracted when passing the refractive section 13A and the vicinity thereof. Therefore, in the light distribution pattern 24A, there is generated a streak 25A of the dark portion where the refracted reflected light comes off, and outside the light distribution pattern 24A, there is generated a streak 26A of the bright portion by the refracted reflected light. The theory of generation of the streak 25A of the dark portion and the streak 26A of the bright portion will be explained below in detail, with reference to FIG. 35 and FIG. 36.

As in the reflector 22, the reflector 22A is for controlling the light distribution, and is formed by combining the reflecting surface of the free-form surface of NURBS (Non-Uniform Rational B-Spline Surface) (see Japanese Patent Application Laid-Open No. 2001-35215). In this reflector 22A, the paraboloid is set to be a reference reflecting surface (basic reflecting surface) in the vertical cross section. On the other hand, a refractive section 13A in the form of line is horizontally provided in the effective luminous region of the lamp lens 5. This lamp lens 5 comprises an upper portion 5U and a lower portion 5D having a different inclination, centering on the refractive section 13A.

The reflected light from the reflector 22A passes the lamp lens 5, and is irradiated outwards in the spread light distribution pattern 24A as shown by a solid line in FIG. 35. At this time, the reflected light passing the lamp lens having no refractive section 13A (not shown) is refracted and shone onto the reverse face of the lamp lens, as shown by the solid line in FIG. 36, and is refracted and emitted respectively in the direction parallel with the incident direction, from the surface of the lamp lens. However, the reflected light passing the lamp lens 5 having the refractive section 13A is refracted and shone onto the refractive section 13AI on the inner side of the lamp lens, as shown by the broken line in FIG. 36, and is emitted from the refractive section 13AO on the outer side of the lamp lens 5 without being refracted.

Therefore, in the lamp lens having no refractive section 13A, the reflected light indicated by the two-dot chain line is irradiated. However, in the lamp lens 5 having the refractive section 13A, the reflected light indicated by the two-dot chain line comes off without being irradiated, and a horizontal streak 25A of the dark portion is generated in the light distribution pattern 24. On the other hand, in the lamp lens having no refractive section 13A, the reflected light indicated by the dotted line is not irradiated. However, in the lamp lens 5 having the refractive section 13A, the reflected light indicated by the dotted line is irradiated, to thereby generate a horizontal streak 26A of the bright portion outside the light distribution pattern 24. As a result, the visibility is deteriorated, and it is not desirable in the appearance.

Figure 37:
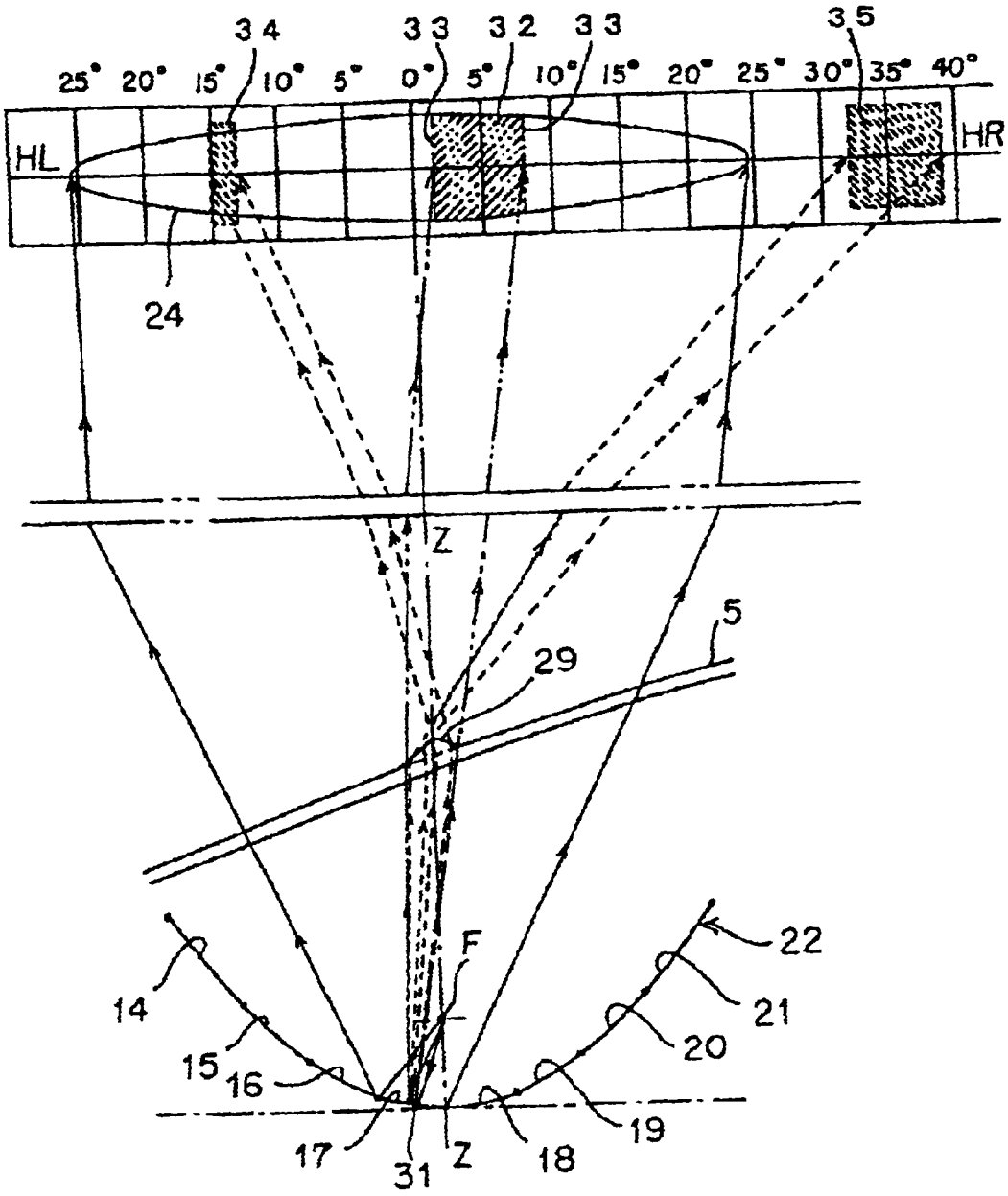
FIG. 37 is a diagram which explains each segment of a reflector which shows the lamp device, in which the design structure is a surface convex prism pattern in the vertical direction, an optical path of a reflected light by each segment, and a light distribution pattern on a screen by each segment.

FIG. 37 is an explanatory diagram which shows the influence of the surface convex prism pattern 29 in the vertical direction upon the light distribution. In the figure, the same reference numerals are given to the parts same as those in FIG. 33 through FIG. 36. In this case, the reflected light from the reflector 22 is refracted when passing the surface convex prism pattern 29. Therefore, a dark portion 32 where the refracted reflected light comes off and a streak 34 of the bright portion where the refracted reflected light is overlapped respectively appear in the light distribution pattern 24, and the bright portion 35 also appears outside the light distribution pattern 24. The theory of appearance of the dark portion 32, the streak 34 of the bright portion and the bright portion 35 will be explained below in detail, with reference to FIG. 37.

The light distribution pattern 24 by the reflected light from the fourth segment 17 of the reflector 22 becomes, as shown by a solid line, a spread light distribution pattern from about 26° on the left to about 24° on the right. At this time, in the lamp lens having no surface convex prism pattern 29 (not shown), the reflected light from a certain point 31 in the fourth segment 17 advances without being refracted, as shown by the two-dot chain line. However, in the lamp lens 5 having the surface convex prism pattern 29, the reflected light is refracted and separated into two directions, left and right, and advances, as shown by the dotted line, when passing the surface convex prism pattern 29.

Therefore, as shown in FIG. 37, in the lamp lens having no surface convex prism pattern 29, the reflected light is irradiated. However, in the lamp lens 5 having the surface convex prism pattern 29, the reflected light comes off without being irradiated, and substantially in the center of the light distribution pattern 24 (about 2° to 8° on the right), the dark portion (shade section) 32 is formed. When this dark portion 32 is formed, a light and shade boundary line 33 is formed on the boundary between the bright portion and the dark portion 32 in the light distribution pattern 24.

On the other hand, in the lamp lens having no surface convex prism pattern 29, the reflected light is not irradiated. However, in the lamp lens 5 having the surface convex prism pattern 29, the reflected light is irradiated and overlapped, and a streak 34 of the bright portion is formed in the vicinity of about 13° to 15° on the left in the light distribution pattern 24, and a bright portion (light storage section) 35 is formed in the vicinity of about 32° to 39° on the right outside the light distribution pattern 24. As a result, the visibility is deteriorated, and it is not desirable in the appearance.

The dark portion 32, the streak 33 of the bright portion and the bright portion 34 shown in FIG. 37 are formed by the reflected light from the fourth segment 17. Here, for example, it is assumed that the reflected light from the third segment 16 to the sixth segment 19 pass through the surface convex prism pattern 29. Then, in the light distribution pattern 24, four streaks of the dark portion and four streaks of the bright portion are respectively formed.

Figure 38:
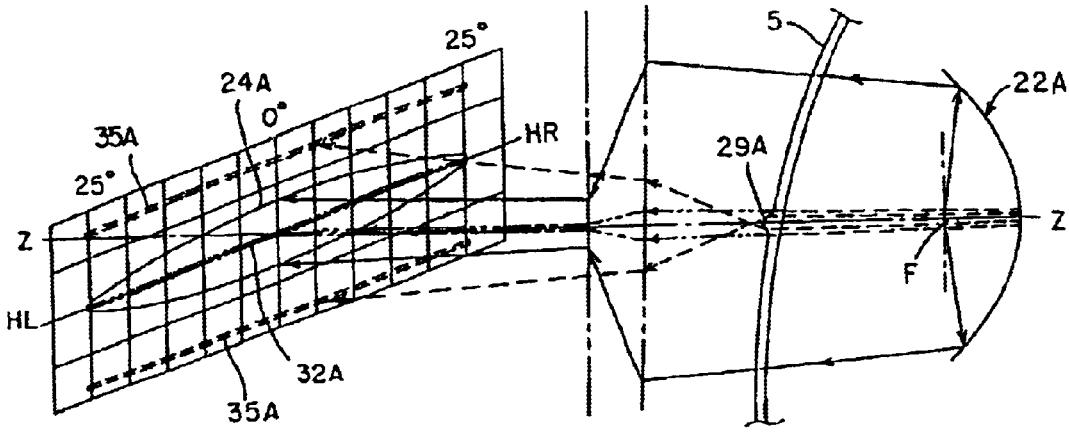
FIG. 38 is a diagram which explains each segment of a reflector which shows the lamp device, in which the design structure is a surface convex prism pattern in the horizontal direction, an optical path of a reflected light by each segment, and a light distribution pattern on a screen by each segment.

FIG. 38 is an explanatory diagram which shows the influence of the surface convex prism pattern 29A in the horizontal direction upon the light distribution. In the figure, the same reference numerals are given to the parts same as those in FIG. 31 through FIG. 37. In this case, the reflected light from the reflector 22A is refracted when passing the surface convex prism pattern 29A, and advances to two directions vertically, according to the same theory as in the example shown in FIG. 37. That is, in the lamp lens having no surface convex prism pattern 29A (not shown), as shown by a two-dot chain line, the reflected light advances without being refracted. However, in the lamp lens having the surface convex prism pattern 29A, as shown by a dotted line, the reflected light is refracted, when passing the surface convex prism pattern 29A, and is separated into two directions, right and left, and advances.

Therefore, as shown in FIG. 38, in the lamp lens having no surface convex prism pattern 29A, the reflected light is irradiated. However, in the lamp lens 5 having the surface convex prism pattern 29A, the reflected light comes off without being irradiated, and substantially in the center of the light distribution pattern 24, a streak 32A of the dark portion is formed.

On the other hand, in the lamp lens having no surface convex prism pattern 29A, the reflected light is not irradiated. However, in the lamp lens 5 having the surface convex prism pattern 29A, the reflected light is irradiated and, and two streaks 35A of the bright portion are formed outside the light distribution pattern 24. As a result, the visibility is deteriorated, and it is not desirable in the appearance.

Figure 39:
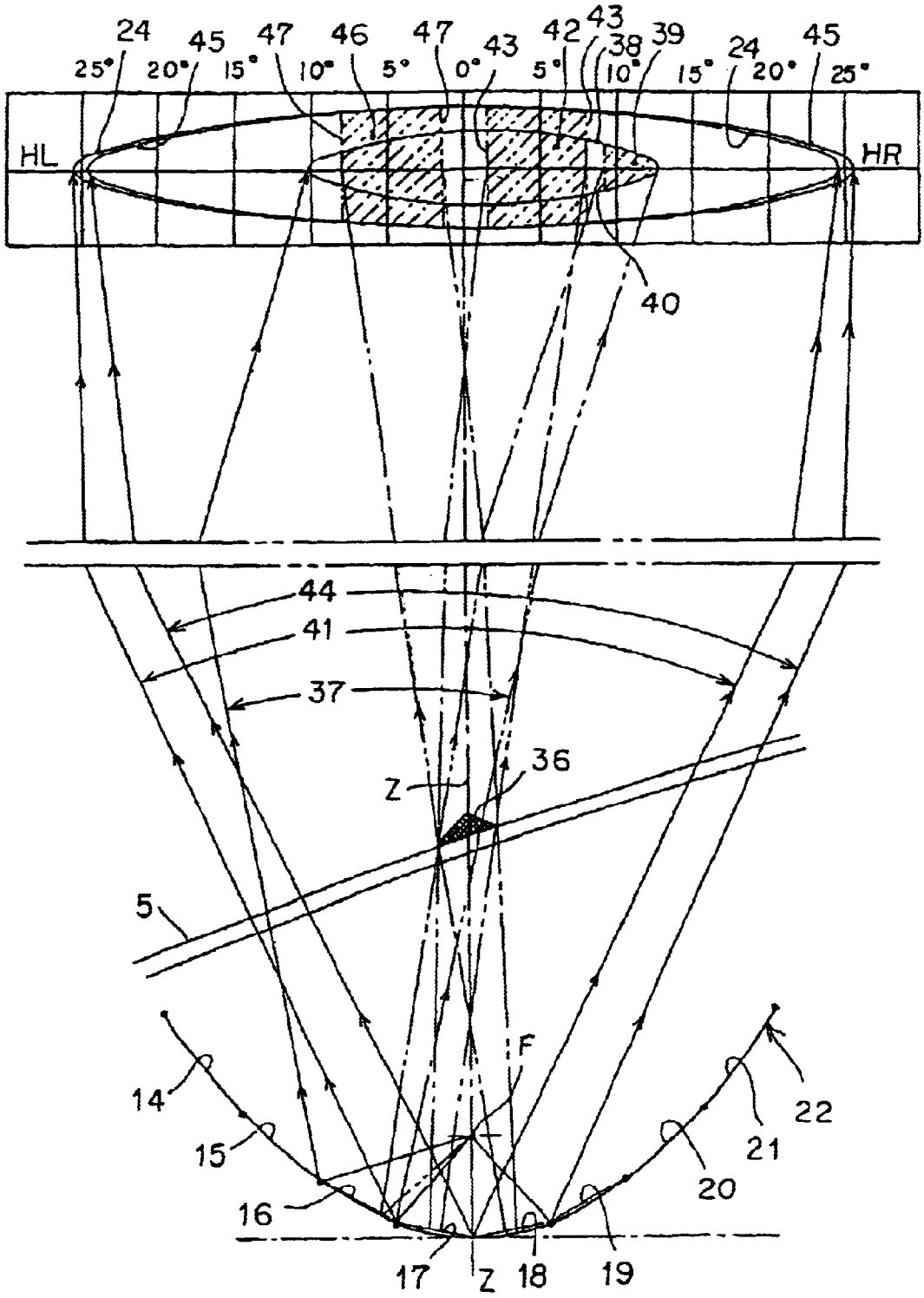
FIG. 39 is a diagram which explains each segment of a reflector which shows the lamp device, in which the design structure is a non-light passing pattern in the vertical direction, an optical path of a reflected light by each segment, and a light distribution pattern on a screen by each segment.

FIG. 39 is an explanatory diagram which shows the influence of a non-light passing pattern 36 in the vertical direction upon the light distribution. In the figure, the same reference numerals are given to the parts same as those in FIG. 31 through FIG. 38. In this case, the reflected light from the reflector 22 is shaded, when passing the non-light passing pattern 36. Therefore, dark portions 39, 42 and 46 where the reflected light is shaded appear in the light distribution pattern 24. The theory of appearance of the dark portion will be explained below, with reference to FIG. 39.

As shown by a solid line in FIG. 39, the light distribution pattern 38 by means of the region of the reflected light from the third segment 16 becomes a light distribution pattern of from about 10° on the left to about 13° on the right. At this time, the reflected light should be irradiated in the lamp lens 5 without having the non-light passing pattern 36 (not shown). However, in the lamp lens 5 having the non-light passing pattern 36, the reflected light is not irradiated but comes off, and as shown by a two-dot chain line in FIG. 39, the dark portion (shade section) 39 is formed in the light distribution pattern 38 of from about 9° to 13° on the right. When this dark portion 39 is formed, a light and shade boundary line 40 is formed on the boundary between the bright portion and the dark portion 39 in the light distribution pattern 38.

As shown by a solid line in FIG. 39, the light distribution pattern 24 by the region 41 of the reflected light from the fourth segment 17 becomes a spread light distribution pattern from about 26° on the left to about 24° on the right. At this time, the reflected light should be irradiated in the lamp lens without having the non-light passing pattern 36. However, the reflected light comes off without being irradiated in the lamp lens 5 having the non-light passing pattern 36, and as shown by a two-dot chain line in FIG. 39, a dark portion (shade section) 42 is formed in the light distribution pattern 24 of from about 2° to 8° on the right. When this dark portion 42 is formed, a light and shade boundary line 43 is formed on the boundary between the bright portion and the dark portion 42 in the light distribution pattern 24.

As shown by a solid line in FIG. 39, the light distribution pattern 45 by the region 44 of the reflected light from the fifth segment 18 becomes a spread light distribution pattern from about 24° on the left to about 26° on the right. At this time, the reflected light should be irradiated in the lamp lens without having the non-light passing pattern 36. However, the reflected light comes off without being irradiated in the lamp lens 5 having the non-light passing pattern 36, and as shown by a two-dot chain line in FIG. 39, a dark portion (shade section) 46 is formed in the light distribution pattern 45 of from about 8° to 2° on the left. When this dark portion 46 is formed, a light and shade boundary line 47 is formed on the boundary between the bright portion and the dark portion 46 in the light distribution pattern 45.

As described above, in the light distribution pattern, three dark portions 39, 42 and 46, and five light and shade boundary lines 40, 43 and 47 appear, and hence the visibility is deteriorated, and it is not desirable in the appearance.

Figure 40:
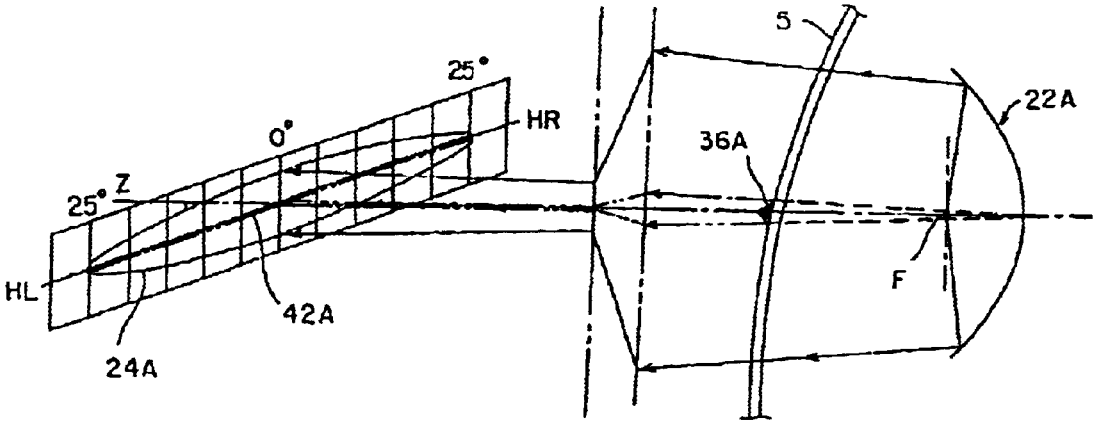
FIG. 40 is a diagram which explains each segment of a reflector which shows the lamp device, in which the design structure is a non-light passing pattern in the horizontal direction, an optical path of a reflected light by each segment, and a light distribution pattern on a screen by each segment.

FIG. 40 is an explanatory diagram which shows the influence of the horizontal non-light passing pattern 36A upon the light distribution. In the figure, the same reference numerals are given to the parts same as those in FIG. 31 through FIG. 39. In this case, the reflected light from the reflector 22A is shaded, when passing the non-light passing pattern 36A, by the same principle as that of the case shown in the FIG. 39.

Therefore, a dark portion 42A where the reflected light is shaded appears in the light distribution pattern 24A. That is, as shown in FIG. 40, the reflected light should be irradiated, as shown by a two-dot chain line, in the lamp lens without having the non-light passing pattern 36 (not shown). However, the reflected light comes off without being irradiated in the lamp lens 5 having the non-light passing pattern 36A, and a dark portion 42A is formed substantially in the middle of the light distribution pattern 24A. As a result, the visibility is deteriorated, and it is not desirable in the appearance.

In a vertical partition section 49 and a vertical shade 50 of the inner panel 48, the light distribution is affected, as with the vertical non-light passing pattern 36 in FIG. 39. Further, in horizontal partition sections 49A, 49E, 49F and 49H and a horizontal shade 50B of the inner panels 48 and 48A, the light distribution is affected, as with the horizontal non-light passing pattern 36A in FIG. 40.

Figure 2:
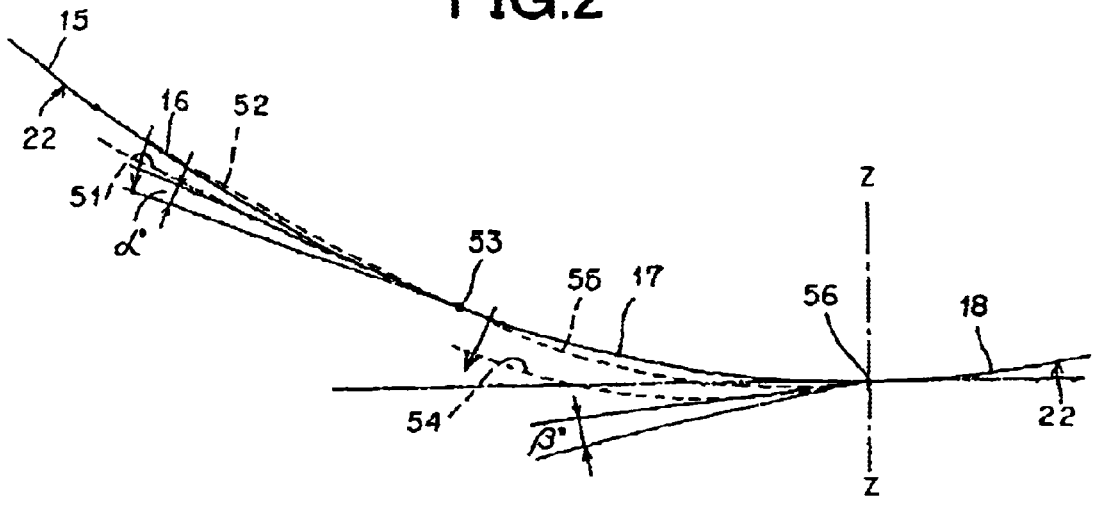
FIG. 2 is an explanatory diagram which shows the construction of a third segment and a fourth segment in an enlarged scale.

FIG. 1 and FIG. 2 show a first embodiment of a lamp device according to this invention. In these figures, the same reference numerals are given to the parts same as those in FIG. 7 through FIG. 40.

In the horizontal cross section, the reflected light from segments substantially facing the vertical refractive section 13 as a design structure in the direction of the optical axis Z—Z, of the eight segments 14 to 21 of the reflector 22, that is in this example, the reflected light from the third segment 16 to the sixth segment 19, passes through the refractive section 13 and the vicinity thereof.

In the third segment 16 to the sixth segment 19 of the reflector 22, there is respectively provided a unit which allows the optical path of the reflected light to avoid the vertical refractive section 13 as a design structure and the vicinity thereof.

The avoidance unit in the third segment 16 is, as shown in FIG. 2, a convex reflecting surface 51 which allows the light from the light source bulb 7 to be reflected in an open spreading manner, being a reflecting surface in the protruding direction (on the side of the reflecting surface and in the inward direction) with respect to the reference reflecting surface (paraboloid) of the reflector 22. This convex reflecting surface 51 inclines with respect to the reference reflecting surface. That is, it forms a virtual convex reflecting surface 52 in the protruding direction with respect to the reference reflecting surface. This virtual convex reflecting surface 52 is rotated by an angle $\alpha°$ in the direction of the arrow (in the outward direction), centering on the boundary 53 between the third segment 16 and the fourth segment 17. As a result, the convex reflecting surface 51 is formed as the avoidance unit.

As shown in FIG. 2, the avoidance unit in the fourth segment 17 is a concave reflecting surface 54 which allows the light from the light source bulb 7 to be reflected in a cross spreading manner, being a reflecting surface in the recessing direction (in the outward direction) with respect to the reference reflecting surface of the reflector 22. This concave reflecting surface 54 inclines with respect to the reference reflecting surface. That is, it forms a virtual concave reflecting surface 55 in the recessing direction with respect to the reference reflecting surface. This virtual concave reflecting surface 54 is rotated by an angle $\beta°$ in the direction of the arrow (in the outward direction), centering on the boundary 56 between the fourth segment 17 and the fifth segment 18. As a result, the concave reflecting surface 54 is formed as the avoidance unit.

Like the avoidance unit in the fourth segment 17, the avoidance unit in the fifth segment 18 is a reflecting surface in the recessing direction with respect to the reference reflecting surface of the reflector 22, and is a concave reflecting surface which allows the light from the light source bulb 7 to be reflected in a cross spreading manner. This concave reflecting surface inclines with respect to the reference reflecting surface. That is, it forms a virtual concave reflecting surface in the recessing direction with respect to the reference reflecting surface. This virtual concave reflecting surface is rotated by an angle $\beta°$ in the outward direction, centering on the boundary 56 between the fourth segment 17 and the fifth segment 18. As a result, the concave reflecting surface 54 is formed as the avoidance unit.

Like the avoidance units in the fourth segment 17 and the fifth segment 18, the avoidance unit in the sixth segment 19 is a reflecting surface in the recessing direction with respect to the reference reflecting surface of the reflector 22, and is a concave reflecting surface which allows the light from the light source bulb 7 to be reflected in a cross spreading manner. This concave reflecting surface does not incline with respect to the reference reflecting surface.

The remaining segments 14, 15, 20 and 21 are respectively convex reflecting surfaces which allow the light from the light source bulb 7 to be reflected in an open spreading manner, being reflecting surfaces in the protruding direction with respect to the reference reflecting surface of the reflector 22. The concave reflecting surface which allows the light to be reflected in a cross spreading manner and the convex reflecting surface which allows the light to be reflected in an open spreading manner are disclosed for example in U.S. Pat. Nos. 4,704,661, 4,959,757, 5,067,053 and Japanese Patent Application Laid-Open No. 10-74406.

The lamp device according to this first embodiment has the above-described construction, and the operation thereof will now be explained.

As shown in FIG. 1, the light distribution pattern 58 due to the region 57 of the reflected light from the first segment 14 (convex reflecting surface) becomes a condensing light distribution pattern of from about 3° on the left to about 2° on the right. At this time, the region 57 of the reflected light from the first segment 14 is made to avoid the vertical refractive section 13 as the design structure and the vicinity thereof.

As shown in FIG. 1, the light distribution pattern 60 due to the region 59 of the reflected light from the second segment 15 (convex reflecting surface) becomes an intermediate light distribution pattern of from about 8° on the left to about 7° on the right. At this time, the region 59 of the reflected light from the second segment 15 is made to avoid the vertical refractive section 13 as the design structure and the vicinity thereof.

As shown in FIG. 1, the light distribution pattern 62 due to the region 61 of the reflected light from the third segment 16 (convex reflecting surface 51 inclined in the outward direction by $\alpha°$) becomes an intermediate light distribution pattern of from about 10° on the left to about 1° on the right. At this time, the region 61 of the reflected light from the third segment 16 is made to avoid the vertical refractive section 13 as the design structure and the vicinity thereof. Particularly, since the convex reflecting surface 51 of the third segment 16 is inclined with respect to the reference reflecting surface, the optical path of the reflected light can be made to avoid the vertical refractive section 13 as the design structure more reliably.

As shown in FIG. 1, the light distribution pattern 64 due to the region 63 of the reflected light from the fourth segment 17 (concave reflecting surface 54 inclined in the outward direction by $\beta°$) becomes a spread light distribution pattern of from about 26° on the left to about 6° on the right. At this time, the region 63 of the reflected light from the fourth segment 17 is made to avoid the vertical refractive section 13 as the design structure and the vicinity thereof. Particularly, since the concave reflecting surface 54 of the fourth segment 17 is inclined with respect to the reference reflecting surface, the optical path of the reflected light can be made to avoid the vertical refractive section 13 as the design structure more reliably.

As shown in FIG. 1, the light distribution pattern 66 due to the region 65 of the reflected light from the fifth segment 18 (concave reflecting surface 54 inclined in the outward direction by β°) becomes a spread light distribution pattern of from about 6° on the left to about 26° on the right, substantially the same as the light distribution pattern 64 by the fourth segment 17. At this time, the region 65 of the reflected light from the fifth segment 18 is made to avoid the vertical refractive section 13 as the design structure and the vicinity thereof. Particularly, since the concave reflecting surface of the fifth segment 18 is inclined with respect to the reference reflecting surface, the optical path of the reflected light can be made to avoid the vertical refractive section 13 as the design structure more reliably.

As shown in FIG. 1, the light distribution pattern 68 due to the region 67 of the reflected light from the sixth segment 19 (concave reflecting surface) becomes an intermediate light distribution pattern of from about 7° on the left to about 11° on the right. At this time, the region 67 of the reflected light from the sixth segment 19 is made to avoid the vertical refractive section 13 as the design structure and the vicinity thereof.

As shown in FIG. 1, the light distribution pattern 70 due to the region 69 of the reflected light from the seventh segment 20 (convex reflecting surface) becomes an intermediate light distribution pattern of from about 7° on the left to about 8° on the right, substantially the same as the light distribution pattern 60 by the second segment 15. At this time, the region 69 of the reflected light from the seventh segment 20 is made to avoid the vertical refractive section 13 as the design structure and the vicinity thereof.

As shown in FIG. 1; the light distribution pattern 72 due to the region 71 of the reflected light from the eighth segment 21 (convex reflecting surface) becomes a condensing light distribution pattern of from about 2° on the left to about 1° on the right, substantially the same as the light distribution pattern 58 by the first segment 14. At this time, the region 71 of the reflected light from the eighth segment 21 is made to avoid the vertical refractive section 13 as the design structure and the vicinity thereof.

From the above, the light distribution pattern is synthesized by the eight segments 14 to 21. Then, the intermediate light distribution pattern of from about 10° on the left to about 11° on the right overlaps on the spread light distribution pattern of from about 26° on the left to about 26° on the right, and further the condensing light distribution pattern of from about 2° on the left to about 1° on the right overlaps thereon. That is, a light distribution pattern suitable for the light distribution pattern for passing by (a light distribution pattern which becomes brighter toward the center, with respect to the horizontally wide light distribution pattern) can be obtained.

As shown in each of the light distribution patterns 58, 60, 62, 64, 66, 68, 70 and 72 in FIG. 1, the fourth segment 17 and the fifth segment 18 close to the light source bulb 7 mainly form a spread light distribution pattern. On the contrary, the first segment 14 and the eighth segment 21 away from the light source bulb 7 mainly form a condensing light distribution pattern. Further, the second segment 15, the third segment 16, the sixth segment 19 and the seventh segment 20 located intermediately with respect to the light source bulb 7 mainly form a light distribution pattern intermediate between the spread light distribution pattern and the condensing light distribution pattern. This is because the light distribution design and the design of the reflecting surface of the segment become easy. That is, the light entering into the segment close to the light source bulb 7 has a larger quantity of luminous flux than other segments. Therefore, designing of the light distribution and the reflecting surface of the segment becomes relatively easy by spreading and reflecting the light having a large quantity of luminous flux to form the spread light distribution pattern. On the contrary, the light entering into the segment away from the light source bulb 7 has a smaller quantity of luminous flux than other segments. Therefore, designing of the light distribution and the reflecting surface of the segment becomes relatively easy by condensing and reflecting the light having a small quantity of luminous flux to form the condensing light distribution pattern. Further, the segment located intermediately with respect to the light source bulb 7 has a medium quantity of luminous flux with respect to the other segments. Therefore, designing of the light distribution and the reflecting surface of the segment becomes relatively easy by reflecting the light having a medium quantity of luminous flux to form the light distribution pattern intermediate between spread and condensing light distribution patterns.

The lamp device according to this first embodiment has such a construction, and the effect thereof will be explained below.

The lamp device according to this first embodiment can make the optical paths 61, 63, 65 and 67 of the reflected light from the third segment 16 to the sixth segment 19 avoid the vertical refractive section 13 as the design structure, by the avoidance unit (the convex reflecting surface 51 and the concave reflecting surface 54) provided in the third segment 16 to the sixth segment 19 of the reflector 22. As a result, in the lamp device according to this first embodiment, the light distribution controlled by the reflector 22 is not affected by the vertical refractive section 13 as the design structure. Therefore, in the invention according to this first embodiment, there is no loss of the reflected light, and the reflected light can be effectively used, thereby bright light distribution can be obtained. Further, the streak 25 of the dark portion where the light comes off, or the streak 26 of the bright portion where the light overlaps on each other does not exist, and hence a predetermined light distribution can be obtained, and the visibility can be maintained. Particularly, in the lamp device according to the first embodiment, there is provided the avoidance unit respectively in the segments facing the vertical refractive section 13 as the design structure in the direction of the optical axis Z—Z, of the eight segments 14 to 21 of the reflector 22, that is, in the third segment 16 to the sixth segment 19 in which the light distribution is most affected by the design structure. Therefore, the optical path of the reflected light from the third segment 16 to the sixth segment 19 can be reliably made to avoid the vertical refractive section 13 as the design structure.

The lamp device according to the first embodiment can positively form a line of the vertical refractive section 13 having a continuous feeling with the press line 12 on the frame forming surface of the vehicle 2, in the irradiation region of the lamp lens 5, without affecting the light distribution pattern. Thereby, the lamp device according to the first embodiment can make the lamp lens 5 in the lamp device a design face continuous from the frame of the vehicle 2. Hence, a novel design can be obtained, and the degree of freedom in designing of the lamp device can be increased, and the sense of unity of the vehicle body and the lamp device increases, to thereby increase the degree of freedom in designing of the vehicle body.

Figure 3:
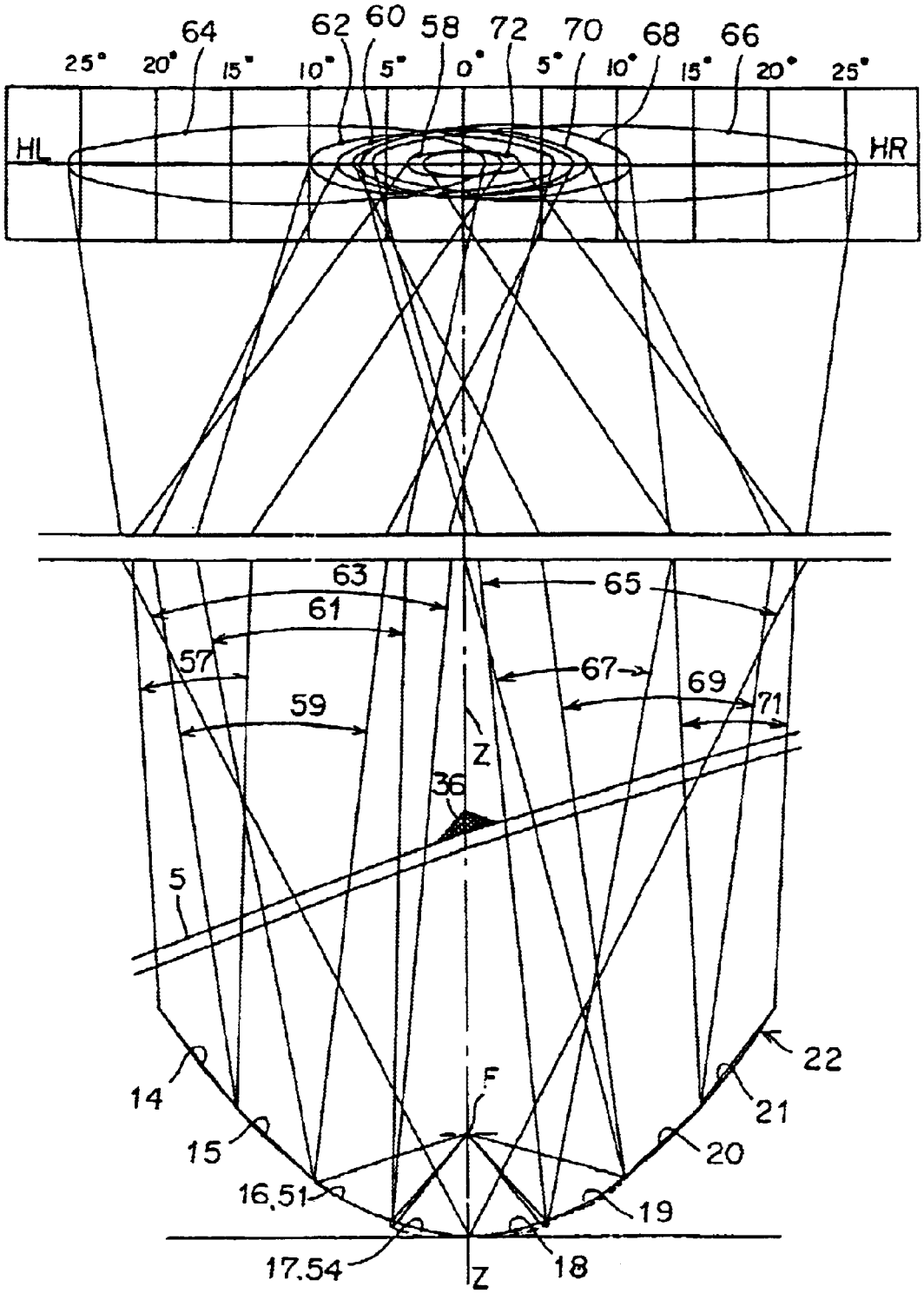
FIG. 3 is a diagram which explains each segment of a reflector, an optical path of a reflected light by each segment, and a light distribution pattern on a screen by each segment, which shows a second embodiment of the lamp device according to this invention.

FIG. 3 shows a second embodiment of the lamp device according to this invention. In the figure, the same reference numerals are given to the parts same as those in FIG. 7 through FIG. 40.

The lamp device according to this second embodiment is one provided with a vertical surface non-light passing pattern 36 as the design structure on the surface of the effective luminous region of the lamp lens 5. That is, in this second embodiment, the vertical surface non-light passing pattern 36 (see FIG. 15 and FIG. 16) is provided as the design structure, instead of the vertical refractive section 13 (see FIG. 7 and FIG. 8) in the first embodiment. The lamp device in the second embodiment can achieve substantially the similar operational effect to that of the first embodiment.

In the first embodiment and the second embodiment, instead of the vertical refractive section 13 (see FIG. 7 and FIG. 8) and the vertical surface non-light passing pattern 36 (see FIG. 15 and FIG. 16), as the design structure, even the vertical surface convex prism pattern 29 and the reverse face convex prism pattern 30 (see FIG. 11 and FIG. 12), the reverse face non-light passing pattern 36 in the vertical direction (see FIG. 15 and FIG. 16), the vertical partition section 49 in the inner panel 48 (see FIG. 19 and FIG. 20), or the vertical shade 50 (see FIG. 26 through FIG. 28) can achieve the similar operational effect.

Figure 4:
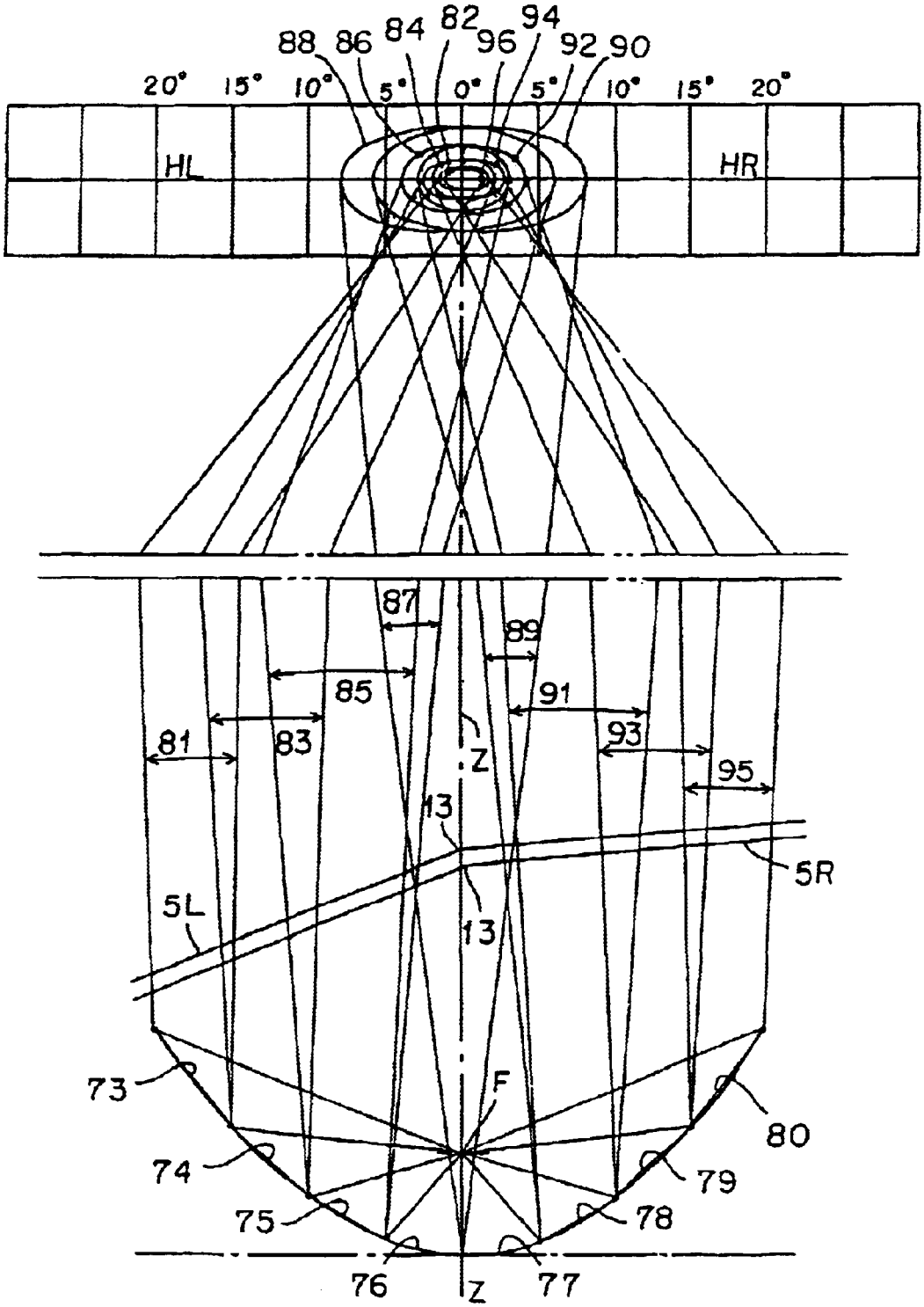
FIG. 4 is a diagram which explains each segment of a reflector, an optical path of a reflected light by each segment, and a light distribution pattern on a screen by each segment, which shows a third embodiment of the lamp device according to this invention.

FIG. 4 shows a third embodiment of the lamp device according to this invention. In the figure, the same reference numerals are given to the parts same as those in FIG. 1 through FIG. 3 and FIG. 7 through FIG. 40.

The lamp device according to this third embodiment is suitable for the lamp device used for a driving lamp, a spot lamp, a fog lamp, and a reflector for driving beams of four-lamp type headlamp.

In this third embodiment, as in the first and second embodiments, the reflector comprises eight segments, from a first segment 73 to an eighth segment 80, in the order from the left to the right, in the horizontal cross section. A unit which allows the optical path of the reflected light to avoid the refractive section 13 as the design structure and the vicinity thereof is provided respectively in the segments facing the vertical refractive section 13 as the design structure, in the direction of the optical axis Z—Z, of the eight segments 14 to 21, that is in this example, in the fourth segment 76 and the fifth segment 77.

The avoidance unit in the fourth segment 76 and the fifth segment 77 is a concave reflecting surface which allows the light from the light source bulb 6 to be reflected in a cross spreading manner, being a reflecting surface in the recessing direction (in the outward direction) with respect to the reference reflecting surface of the reflector. Other segments 73, 74, 75, 78, 79 and 80 are convex reflecting surfaces which allow the light from the light source bulb 6 to be reflected in an open spreading manner respectively, being reflecting surfaces in the protruding direction with respect to the reference reflecting surface of the reflector 22. The concave reflecting surfaces in the fourth segment 76 and the fifth segment 77 may be inclined with respect to the reference reflecting surface.

Since this third embodiment has the above-described construction, the reflected light from the first segment 73 (convex reflecting surface) avoids the refractive section 13 and the vicinity thereof due to the region 81, and a condensing light distribution pattern 82 can be obtained. The reflected light from the second segment 74 (convex reflecting surface) avoids the refractive section 13 and the vicinity thereof due to the region 83, and a condensing light distribution pattern 84 can be obtained. The reflected light from the third, segment 75 (convex reflecting surface) avoids the refractive section 13 and the vicinity thereof due to the region 85, and a condensing light distribution pattern 86 can be obtained. The reflected light from the fourth segment 76 (concave reflecting surface) avoids the refractive section 13 and the vicinity thereof due to the region 87, and a condensing light distribution pattern 88 can be obtained. The reflected light from the fifth segment 77 (concave reflecting surface) avoids the refractive section 13 and the vicinity thereof due to the region 89, and a condensing light distribution pattern 90 can be obtained. The reflected light from the sixth segment 78 (convex reflecting surface) avoids the refractive section 13 and the vicinity thereof due to the region 91, and a condensing light distribution pattern 92 can be obtained. The reflected light from the seventh segment 79 (convex reflecting surface) avoids the refractive section 13 and the vicinity thereof due to the region 93, and a condensing light distribution pattern 94 can be obtained. The reflected light from the eighth segment 80 (convex reflecting surface) avoids the refractive section 13 and the vicinity thereof due to the region 95, and a condensing light distribution pattern 96 can be obtained. Then, by synthesizing the light distribution patterns, a condensing light distribution pattern can be obtained, which is suitable for a driving lamp, a spot lamp, a fog lamp and a headlamp for driving.

In this third embodiment, by increasing the number of division of the segments in the reflector (reflecting surface) or changing the light distribution control of the reflector (reflecting surface), it is also applicable to a passing-by beam or a corner irradiation lamp.

The one in this third embodiment can achieve substantially the same operational effect as that of the first and second embodiments. In the third embodiment, even when the design structure is the vertical surface convex prism pattern 29, the reverse face convex prism pattern 30 (see FIG. 11 and FIG. 12), the surface non-light passing pattern 36 or the reverse face non-light passing pattern 36 in the vertical direction (see FIG. 15 and FIG. 16), the vertical partition section 49 of the inner panel 48 (see FIG. 19 and FIG. 20), or the vertical shade 50 (see FIG. 26 through FIG. 28), instead of the vertical refractive section 13 (see FIG. 7 and FIG. 8), the similar operational effect can be achieved.

In the first, second and third embodiments, a vertical prism section in the form of line continuous to a triangular convex and concave line on the vehicle body can be provided in the effective luminous region of the lamp lens, thereby a novel design of the lamp lens and the vehicle body having a continuous feeling can be obtained. Further, a vertical non-light passing section in the form of line continuous to the triangular convex and concave line on the vehicle body can be provided in the effective luminous region of the lamp lens, thereby a novel design of the lamp lens and the vehicle body having a continuous feeling can be obtained. Furthermore, a partition section which horizontally separates the lamp chamber into a plurality of numbers may be provided in the effective luminous region of the lamp chamber, and hence a novel design of a simulated multiple light lamp in which the lamp chamber 3 is horizontally separated into a plurality of numbers can be obtained. The degree of freedom in designing of the lamp device and the degree of freedom in designing of the vehicle body can be also increased.

Figure 5:
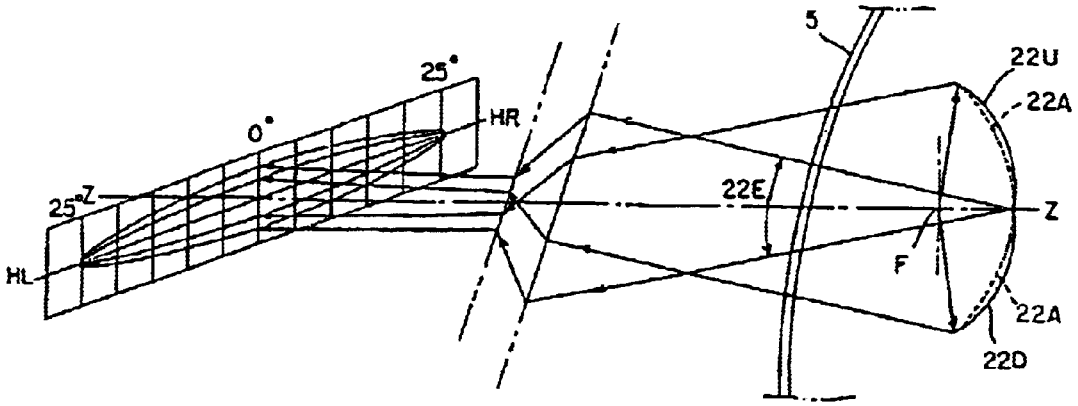
FIG. 5 is a diagram which explains each segment of a reflector, an optical path of a reflected light by each segment, and a light distribution pattern on a screen by each segment, which shows a fourth embodiment of the lamp device according to this invention.
Figure 6:
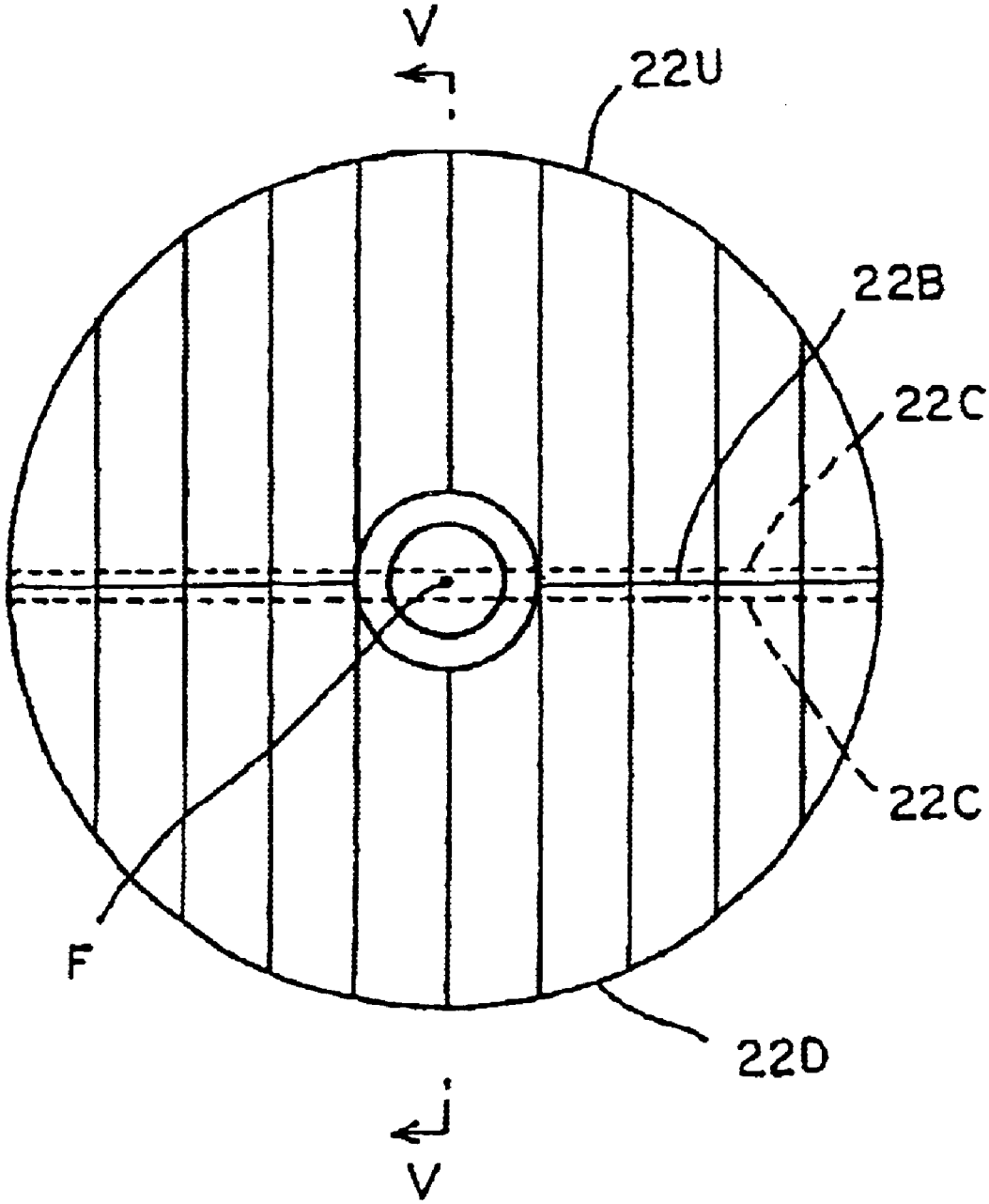
FIG. 6 is an elevational view of the reflector.

FIG. 5 and FIG. 6 show a fourth embodiment of the lamp device according to this invention. In the figure, the same reference numerals are given to the parts same as those in FIG. 1 through FIG. 4 and FIG. 7 through FIG. 40.

The lamp device according to this fourth embodiment is provided with a design structure in the horizontal direction in the lamp lens 5 and the effective luminous region 22E in the lamp chamber 3. This horizontal design structure includes, for example, the horizontal refractive section 13A (see FIG. 9 and FIG. 10), the horizontal surface convex prism pattern 29A (see FIG. 13 and FIG. 14) and the reverse face convex prism pattern (not shown), the horizontal surface non-light passing pattern 36A (see FIG. 17 and FIG. 18) and the reverse face non-light passing pattern 36 (not shown), the horizontal partition sections 49A, 49E, 49F and 49H of the inner panels 48, 48A (see FIG. 21 through FIG. 25), and the horizontal shade 50B (see FIG. 29 and FIG. 30).

In the lamp device according to the fourth embodiment, the reflectors are divided into 22U and 22D vertically at a point facing the horizontal design structure, substantially in the direction of the optical axis Z—Z. For example, it is assumed that the horizontal design structure is provided in the lamp lens 5 and in the effective luminous region 22E in the lamp chamber 3 shown in FIG. 5, and in the region of the central right and left horizontal section (in the region between two upper and lower dotted lines 22C) of the reflectors 22U and 22D shown in FIG. 6. At this time, the reflectors 22U and 22D are divided vertically at the central line 22B horizontal on the right and left sides.

The upper reflector 22U and the lower reflector 22D are provided with an avoidance unit. This avoidance unit is a reflecting surface in the recessing direction with respect to the reference reflecting surface of the reflector 22A, and is a concave reflecting surface which allows the light from the light source to be reflected in a cross spreading manner. The vertical cross section of the reflectors 22A, 22U and 22D is a cross section along the line V—V in FIG. 6.

The lamp device according to the fourth embodiment has such a construction, and hence the reflected light from the upper reflector 22U (concave reflecting surface) and the lower reflector 22D (concave reflecting surface) is respectively reflected in a cross spreading manner to avoid the horizontal design structure and the vicinity thereof, and pass the lamp lens 5. The light reflected in a cross spreading manner having passed the lamp lens 5 is vertically inverted and irradiated outside.

As described above, the lamp device according to the fourth embodiment can allow the optical path of the reflected light from the upper and lower reflectors 22U and 22D to avoid the horizontal design structure. Therefore, the light distribution controlled by the reflectors 22U and 22D is not affected by the design structure. Therefore, in the lamp device according to the fourth embodiment, as in the first, second and third embodiments, the horizontal design structure can be provided in the effective luminous region of the lamp device without affecting the light distribution, and the degree of freedom in designing of the lamp device can be increased.

Particularly, in the lamp device in the fourth embodiment, the reflector is divided into upper and lower reflectors 22U and 22D, at a point 22B facing the horizontal design structure substantially in the optical direction Z—Z, that is, at the point 22B where the light distribution is most affected by the design structure, and the concave reflecting surface, being an avoidance unit, is provided in the upper and lower reflectors 22U and 22D. Therefore, the optical path of the reflected light from the upper and lower reflectors 22U and 22D can be made to avoid the horizontal design structure reliably.

In the fourth embodiment, the concave reflecting surface of the upper and lower reflectors 22U and 22D may be inclined with respect to the reference reflecting surface. Particularly, in this case, since the concave reflecting surface of the upper and lower reflectors 22U and 22D is inclined with respect to the reference reflecting surface, the direction of the close spread reflection can be controlled. As a result, the optical path of the reflected light from the upper and lower reflectors 22U and 22D can be made to avoid the horizontal design structure more reliably.

In the above embodiments, a lamp device in which the lamp housing 4 and the reflectors 9, 10 and 11 are separate bodies has been explained. However, this invention is also applicable to a lamp device in which the lamp housing and the reflector are one united body.

In the above embodiments, the headlamp 1 has also been explained, but this invention is also applicable to a lamp other than the headlamp 1.

In this invention, by changing the installation of the partition section of the inner panel or the shade, by increasing the segments of the reflector (division of the reflecting surface), or by using a light source bulb having one bulb and two light sources, such as H4, HB2 and double arc HID, there can be formed a combination of a driving beam and a fog lamp, a combination of a driving beam and a cornering lamp, a combination of a passing-by lamp and a fog lamp, or a combination of a passing-by beam and a cornering lamp.

In the above embodiments, the design structure is provided vertically or horizontally, but in this invention, the design structure may be provided slantwise.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

The entire contents of Japanese Patent Applications No. 2001-194877 (filed Jun. 27, 2001) and No. 2002-142092 (filed May 16, 2002), to which priority is claimed, are hereby incorporated by reference.

What is claimed is:

1. A lamp device comprising:

a lamp chamber having a lamp housing and a lamp lens; and a light source and a reflector provided in the lamp chamber, wherein the reflector reflects the light from the light source so as to pass through the lamp lens and be irradiated outside, wherein the lamp lens is provided with a line pertaining to design and continuous with a line pertaining to design provided on a vehicle body in an effective luminous region of the lamp lens, the effective luminous region being an optical path of the reflected light from the reflector; and wherein the reflector is provided with an avoidance unit which allows the optical path of the reflected light to avoid the line pertaining to design on the lamp lens.

2. The lamp device according to claim 1, wherein the line pertaining to design on the vehicle body includes one or a plurality of press line, crevice line between the hood and the fender, triangular convex line, triangular concave line, convex line, concave line, joint line of the vehicle body, paint line, printing line and line of a separate piece attached afterwards;

wherein the line pertaining to design of the lamp lens includes one or a plurality of refractive section in the form of line, prism section in the form of line, non-light passing section in the form of line, convex and concave portion in the form of line, painting section in the form of line, printer in the form of line, and stamper in the form of line; and wherein the line pertaining to design on the vehicle body and the line pertaining to design on the lamp lens include a line continuously lined up in a row and a line intermittently lined up in a row.

3. The lamp device according to claim 1, wherein the line pertaining to design on the lamp lens is at least one of:

a refractive section in the form of line provided vertically in the effective luminous region of the lamp lens, so as to be continuous to a press line pertaining to design provided on the vehicle body or a crevice line between the hood and the fender;

a prism section in the form of line provided vertically in at least one of the effective luminous region on the surface and the reverse face of the lamp lens, so as to be continuous to at least one of a triangular convex line and triangular concave line pertaining to design provided on the vehicle body; and a non-light passing section in the form of line provided vertically in at least one of the effective luminous region on the surface and the reverse face of the lamp lens, so as to be continuous to at least one of a convex line and concave line pertaining to design provided on the vehicle body.

4. The lamp device according to claim 3, wherein the reflector is formed of a plurality of segments in a horizontal cross section, and of the plurality of segments, in the segment facing the vertical line pertaining to design on the lamp lens in the direction of an optical axis Z—Z, the avoidance unit is provided; and wherein the avoidance unit is at least one of:

(a) a concave reflecting surface which allows the light from the light source to be reflected in across spreading manner, the concave reflecting surface being a reflecting surface in a recessed direction with respect to a reference reflecting surface of the reflector, (b) the concave reflecting surface being inclined with respect to the reference reflecting surface of the reflector, (c) a convex reflecting surface which allows the light from the light source to be reflected in an open spreading manner, the convex reflecting surface being a reflecting surface in a protruded direction with respect to the reference reflecting surface of the reflector, and (d) the convex reflecting surface being inclined with respect to the reference reflecting surface of the reflector.

5. The lamp device according to claim 3, wherein the line pertaining to design of the lamp lens is provided vertically so as to pass through the optical axis or the vicinity thereof;

the reflector is formed of eight segments, a first segment to an eighth segment from the left, in the horizontal cross section;

the optical axis passes between the fourth segment and the fifth segment or the vicinity thereof, of the eight segments;

in the segments from the third segment to the sixth segment, of the eight segments, the avoidance unit is provided;

the avoidance unit in the third segment is a convex reflecting surface which allows the light from the light source to be reflected in an open spreading manner, being a reflecting surface in the protruding direction with respect to the reference reflecting surface of the reflector, and is inclined with respect to the reference reflecting surface;

the avoidance unit in the fourth segment and the fifth segment is a concave reflecting surface which allows the light from the light source to be reflected in across spreading manner, being a reflecting surface in the recessing direction with respect to the reference reflecting surface of the reflector, and is inclined with respect to the reference reflecting surface;

the avoidance unit in the sixth segment is a concave reflecting surface which allows the light from the light source to be reflected in a cross spreading manner, being a reflecting surface in the recessing direction with respect to the reference reflecting surface of the reflector; and the remaining segments are convex reflecting surfaces which allow the light from the light source to be reflected in an open spreading manner, being reflecting surfaces in the protruding direction with respect to the reference reflecting surface of the reflector.

6. The lamp device according to claim 3, wherein the line pertaining to design of the lamp lens is provided vertically so as to pass through the optical axis or the vicinity thereof;

the reflector is formed of eight segments, a first segment to an eighth segment from the left, in the horizontal cross section;

the optical axis passes between the fourth segment and the fifth segment or the vicinity thereof, of the eight segments;

in the fourth segment and the fifth segment of the eight segments, the avoidance unit is provided;

the avoidance unit in the fourth segment and the fifth segment is a concave reflecting surface which allows the light from the light source to be reflected in a cross spreading manner, being a reflecting surface in the recessing direction with respect to the reference reflecting surface of the reflector; and the other segments are convex reflecting surfaces which allow the light from the light source to be reflected in an open spreading manner, being reflecting surfaces in the protruding direction with respect to the reference reflecting surface of the reflector.

7. The lamp device according to claim 1, wherein the line pertaining to design of the lamp lens is at least one of:

a refractive section in the form of line provided horizontally in the effective luminous region of the lamp lens so as to be continuous to a press line pertaining to design or a refractive section in the form of line provided on the vehicle body;

a prism section in the form of line provided horizontally in at least one of the effective luminous region on the surface and the reverse face of the lamp lens, so as to be continuous to at least one of a triangular convex line and triangular concave line pertaining to design provided on the vehicle body; and a non-light passing section in the form of line provided horizontally in at least one of the effective luminous region on the surface and the reverse face of the lamp lens, so as to be continuous to at least one of a convex line and concave line pertaining to design provided on the vehicle body.

8. The lamp device according to claim 7, wherein the reflector is divided vertically, at a point facing the horizontal line pertaining to design on the lamp lens in the direction of the optical axis, and the avoidance unit is provided in the upper reflector and the lower reflector; and wherein the avoidance unit is at least one of:

(a) concave reflecting surface which allows the light from the light source to be reflected in across spreading manner, the concave reflecting surface being a reflecting surface in a recessed direction with respect to the reference reflecting surface of the reflector, and (b) the concave reflecting surface being inclined with respect to the reference reflecting surface.

9. A lamp device in which a lamp chamber is divided by a lamp housing and a lamp lens, and a light source and a reflector which reflects the light from the light source so as to pass the lamp lens and be irradiated outside are respectively arranged in the lamp chamber, comprising:

a partition section in view of a design is provided in an inner panel so as to face the lamp lens, in the effective luminous region of the lamp chamber, wherein the reflector is provided with an avoidance unit which allows the optical path of the reflected light to avoid the partition section in view of the design in the inner panel.

10. The lamp device according to claim 9, wherein the partition section in view of the design comprises a non-light passing material, and is provided vertically in the inner panel so as to face the lamp lens, in the effective luminous region of the lamp chamber.

11. The lamp device according to claim 10, wherein the reflector is formed of a plurality of segments in a horizontal cross section, and of the plurality of segments, in the segment facing the vertical partition section in view of the design in the inner panel, in the direction of an optical axis, the avoidance unit is provided; and wherein the avoidance unit is at least one of:

(a) a concave reflecting surface which allows the light from the light source to be reflected in a cross spreading manner, the concave reflecting surface comprising a reflecting surface in a recessed direction with respect to the reference reflecting surface of the reflector, (b) the concave reflecting surface being inclined with respect to the reference reflecting surface of the reflector, (c) a convex reflecting surface which allows the light from the light source to be reflected in an open spreading manner, the convex reflecting surface comprising a reflecting surface in a protruded direction with respect to the reference reflecting surface of the reflector, and (d) the convex reflecting surface being inclined with respect to the reference reflecting surface of the reflector.

12. The lamp device according to claim 10, wherein the partition section in view of the design in the inner panel is provided vertically so as to pass through the optical axis or the vicinity thereof:

the reflector is formed of eight segments, a first segment to an eighth segment from the left, in the horizontal cross section;

the optical axis passes between the fourth segment and the fifth segment or the vicinity thereof, of the eight segments;

in the segments from the third segment to the sixth segment, of the eight segments, the avoidance unit is provided;

the avoidance unit in the third segment is a convex reflecting surface which allows the light from the light source to be reflected in an open spreading manner, the convex reflecting surface comprising a reflecting surface in the protruding direction with respect to the reference reflecting surface of the reflector, and is inclined with respect to the reference reflecting surface;

the avoidance unit in the fourth segment and the fifth segment is a concave reflecting surface which allows the light from the light source to be reflected in a cross spreading manner, the concave reflecting surface comprising a reflecting surface in the recessing direction with respect to the reference reflecting surface of the reflector, and is inclined with respect to the reference reflecting surface;

the avoidance unit in the sixth segment is a concave reflecting surface which allows the light from the light source to be reflected in a cross spreading manner, the concave reflecting surface comprising a reflecting surface in a recessed direction with respect to the reference reflecting surface of the reflector; and the remaining segments are convex reflecting surfaces which allow the light from the light source to be reflected in an open spreading manner, the convex reflecting surfaces comprising reflecting surfaces in the protruding direction with respect to the reference reflecting surface of the reflector.

13. The lamp device according to claim 10, wherein the partition section in view of the design in the inner panel is provided vertically so as to pass through the optical axis or the vicinity thereof;

the reflector is formed of eight segments, a first segment to an eighth segment from the left, in the horizontal cross section;

the optical axis passes between the fourth segment and the fifth segment or the vicinity thereof, of the eight segments;

in the fourth segment and the fifth segment of the eight segments, the avoidance unit is provided;

the avoidance unit in the fourth segment and the fifth segment is a concave reflecting surface which allows the light from the light source to be reflected in across spreading manner, the concave reflecting surface comprising a reflecting surface in the recessing direction with respect to the reference reflecting surface of the reflector; and the other segments are convex reflecting surfaces which allow the light from the light source to be reflected in an open spreading manner, the convex reflecting surfaces comprising reflecting surfaces in the protruding direction with respect to the reference reflecting surfaces of the respective reflectors.

14. The lamp device according to claim 9, wherein the partition section in view of the design comprises a non-light passing material, and is provided horizontally in the inner panel so as to face the lamp lens, in the effective luminous region of the lamp chamber.

15. The lamp device according to claim 14, wherein the reflector is divided vertically, at a point facing the horizontal partition section in view of the design in the inner panel, in the direction of the optical axis, and the avoidance unit is provided in the upper reflector and the lower reflector; and wherein the avoidance unit is at least one of:

(a) a concave reflecting surface which allows the light from the light source to be reflected in a cross spreading manner, the concave reflecting surface comprising a reflecting surface in a recessed direction with respect to the reference reflecting surface of the reflector, and (b) the concave reflecting surface being inclined with respect to the reference reflecting surface.

16. A lamp device in which a lamp chamber is divided by a lamp housing and a lamp lens, and a light source and a reflector which reflects the light from the light source so as to pass the lamp lens and be irradiated outside are respectively arranged in the lamp chamber, comprising:

a shade in a partition section in view of a design is provided on the reflector so as to face the lamp lens, in the effective luminous region of the lamp chamber, wherein the reflector is provided with an avoidance unit which allows the optical path of the reflected light to avoid the shade in view of the design.

17. The lamp device according to claim 16, wherein the shade in view of the design is provided vertically on the reflector, so as to face the lamp lens, in the effective luminous region of the lamp chamber.

18. The lamp device according to claim 17, wherein the reflector is formed of a plurality of segments in a horizontal cross section, and of the plurality of segments, in the segment facing the vertical shade in view of the design, in the direction of an optical axis, the avoidance unit is provided; and wherein the avoidance unit is at least one of:

(a) a concave reflecting surface which allows the light from the light source to be reflected in a cross spreading manner, the concave reflecting surface comprising a reflecting surface in a recessed direction with respect to the reference reflecting surface of the reflector, (b) the concave reflecting surface being inclined with respect to the reference reflecting surface of the reflector, (c) a convex reflecting surface which allows the light from the light source to be reflected in an open spreading manner, the convex reflecting surface comprising a reflecting surface in a protruded direction with respect to the reference reflecting surface of the reflector, and (d) the convex reflecting surface being inclined with respect to the reference reflecting surface of the reflector.

19. The lamp device according to claim 17, wherein the shade in view of the design is provided vertically so as to pass through the optical axis or the vicinity thereof;

the reflector is formed of eight segments, a first segment to an eighth segment from the left, in the horizontal cross section;

the optical axis passes between the fourth segment and the fifth segment or the vicinity thereof, of the eight segments;

in the segments from the third segment to the sixth segment, of the eight segments, the avoidance unit is provided;

the avoidance unit in the third segment is a convex reflecting surface which allows the light from the light source to be reflected in an open spreading manner, the convex reflecting surface in the third segment comprising a reflecting surface in the protruding direction with respect to the reference reflecting surface of the reflector, and is inclined with respect to the reference reflecting surface;

the avoidance unit in the fourth segment and the fifth segment is a concave reflecting surface which allows the light from the light source to be reflected in a cross spreading manner, the concave reflecting surface in each of the fourth and fifth segments comprising a reflecting surface in a recessed direction with respect to the reference reflecting surface of the reflector, and is inclined with respect to the reference reflecting surface;

the avoidance unit in the sixth segment is a concave reflecting surface which allows the light from the light source to be reflected in a cross spreading manner, the concave reflecting surface in the sixth segment comprising a reflecting surface in the recessed direction with respect to the reference reflecting surface of the reflector; and wherein the remaining segments are convex reflecting surfaces which allow the light from the light source to be reflected in an open spreading manner, the convex reflecting surfaces being reflecting surfaces in the protruding direction with respect to the respective reference reflecting surfaces of the reflectors.

20. The lamp device according to claim 17, wherein the shade in view of the design is provided vertically so as to pass through the optical axis or the vicinity thereof;

the reflector is formed of eight segments, a first segment to an eighth segment from the left, in the horizontal cross section;

the optical axis passes between the fourth segment and the fifth segment or the vicinity thereof, of the eight segments;

in the fourth segment and the fifth segment of the eight segments, the avoidance unit is provided;

the avoidance unit in the fourth segment and the fifth segment is a concave reflecting surface which allows the light from the light source to be reflected in across spreading manner, the concave reflecting surface comprising a reflecting surface in the recessing direction with respect to the reference reflecting surface of the reflector; and the other segments are convex reflecting surfaces which allow the light from the light source to be reflected in an open spreading manner, the convex reflecting surfaces comprising reflecting surfaces in the protruding direction with respect to the reference reflecting surfaces of the respective reflectors.

21. The lamp device according to claim 16, wherein the shade in view of the design is provided horizontally on the reflector, so as to face the lamp lens, in the effective luminous region of the lamp chamber.

22. The lamp device according to claim 21, wherein the reflector is divided vertically, at a point facing the horizontal shade in view of the design, in the direction of the optical axis, and an avoidance unit is provided in the upper reflector and the lower reflector; and wherein the avoidance unit is at least one of:

(a) a concave reflecting surface which allows the light from the light source to be reflected in a cross spreading manner, the concave reflecting surface comprising a reflecting surface in a recessed direction with respect to the reference reflecting surface of the reflector, and (b) the concave reflecting surface being inclined with respect to the reference reflecting surface.

23. A combination of a vehicle body and lamp device comprising:

a lamp chamber having a lamp housing and a lamp lens; and a light source and a reflector provided in the lamp chamber, wherein the reflector reflects the light from the light source so as to pass through the lamp lens and be irradiated outside, wherein the lamp lens is provided with a line pertaining to design, and continuous with a line pertaining to design provided on a vehicle body, in an effective luminous region of the lamp lens, the effective luminous region of the lamp lens being an optical path of the reflected light from the reflector, and the reflector is provided with an avoidance unit which allows the optical path of the reflected light to avoid the line pertaining to design on the lamp lens.

* * * * *